US007621525B2

(12) United States Patent
Kanome et al.

(10) Patent No.: US 7,621,525 B2
(45) Date of Patent: Nov. 24, 2009

(54) SHEET SUPPLY APPARATUS WITH TWO STACKING PORTIONS

(75) Inventors: Yuji Kanome, Kanagawa (JP); Yasuyuki Asai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 392 days.

(21) Appl. No.: 10/824,525

(22) Filed: Apr. 15, 2004

(65) Prior Publication Data

US 2004/0207144 A1 Oct. 21, 2004

(30) Foreign Application Priority Data

Apr. 18, 2003 (JP) ..... 2003-113913
Apr. 18, 2003 (JP) ..... 2003-113983
Aug. 29, 2003 (JP) ..... 2003-308002

(51) Int. Cl.
*B65H 1/00* (2006.01)

(52) U.S. Cl. ..... 271/162

(58) Field of Classification Search ..... 271/145, 271/171, 162

See application file for complete search history.

(56) References Cited

U.S. PATENT DOCUMENTS 5,109,236 A * 4/1992 Watanabe et al. ..... 347/193
5,116,034 A * 5/1992 Trask et al. ..... 271/2
5,219,155 A 6/1993 Kanome ..... 271/114
5,379,997 A * 1/1995 Ohta ..... 271/145
5,816,723 A 10/1998 Takahashi et al. ..... 400/624
5,904,329 A 5/1999 Kanome et al. ..... 248/201
6,315,280 B1 * 11/2001 Jang ..... 271/9.02
6,331,002 B1 12/2001 Yoshino et al. ..... 271/117
6,406,201 B1 6/2002 Beretta et al. ..... 400/605
6,469,811 B1 * 10/2002 Tamura ..... 358/498
6,942,211 B2 * 9/2005 Teo et al. ..... 271/145

FOREIGN PATENT DOCUMENTS

JP 61127531 A * 6/1986
JP 2001-301994 10/2001
JP 2001301994 A * 10/2001
JP 2002-154690 5/2002

OTHER PUBLICATIONS

Hewlett-Packard Company, HP Officejet 630 All-in-One: Manuals, 1997, http://h10032.www1.hp.com/ctg/Manual/bpu60078.pdf, pp. 2, 1-3, 1-6, 2-4, 8-2.*

* cited by examiner

*Primary Examiner*—Patrick H Mackey
*Assistant Examiner*—Gerald W McClain
(74) *Attorney, Agent, or Firm*—Fitzpatrick, Cella, Harper & Scinto

(57) ABSTRACT

A sheet supplying apparatus has a first stacking portion with a sheet, a second stacking portion movable relative to the first stacking portion, and a supplying roller used in common to the first and second stacking portions, for supplying the stacked sheets. The second stacking portion is movable between a retreat position where the second stacking portion retreats so that the sheet can be supplied from the first stacking portion, and, a supply position where the second stacking portion advances, so the sheet can be supplied from the second stacking portion.

11 Claims, 23 Drawing Sheets

SHEET SUPPLY APPARATUS WITH TWO STACKING PORTIONS

BACKGROUND OF THE INVENTION

1. Field of the Invention

The present invention relates to a sheet supplying apparatus including a sensor for automatically identifying a type of a sheet recording medium (which will hereinafter simply be called a "recording sheet"), and to a recording apparatus (which will hereinafter be referred to as a "printer") mounted with this supplying apparatus.

2. Description of the Related Art

Over the recent years, an image quality that is as beautiful and definite as a silver-film photograph has been required of a color inkjet printer and is now getting close to this level. Therefore, demands for printing photos of a postcard size, an L-size, etc. are increasing at home.

Contrivances have been required of recording mediums, and for realizing a silver-film photographic tone, recording sheets of which surface states exhibit a glossy tone, a semi-glossy tone, a matte tone, etc., have been developed. So, a user can select a favorite type of sheet.

Herein, generally in the different types of recording sheets, a coloring state and an ink absorbing state often differ depending on materials coated over their surfaces. It is therefore ordinary to optimize color image processing and an ink injecting amount by changing them for each type of the recording sheet (which will hereinafter also be called a "sheet type"). The selection of this optimization is processed on a printer driver as software stored on a host computer (which may hereinafter be termed a "PC") connected to the printer. Then, it is preset that the user performs the operation of selecting which recording sheet is now to be used and has a necessity of conducting operations such as selecting a recording target sheet type on an operation screen of the printer driver when printing. This operation is troublesome and might be easy to induce a mistake on the side of an unaccustomed user. Hence, printers each mounted with a sheet type discriminating sensor for automatically discriminating the recording sheets, have been developed in recent years. A typical discriminating means for discriminating between the sheet types is an optical sensor disclosed in, e.g., U.S. Pat. No. 5,109,236. A print (a record of an image) suited to the recording sheet discriminated by the discriminating means is automatically obtained, and therefore the operation mistake can be prevented.

Further, it is also required that the user inserts the recording sheet to be recorded into a sheet supply stacking portion (which is generally one portion) of the printer and thus effects the printing. It is, however, assumed as a normal using condition to separately use the sheets such as employing the plain paper at a certain time and a photographic sheet at another time. Accordingly, after conducting photographic tone printing, this photographic sheet should be removed and replaced by the plain paper, or the operations reversed to those described above should be performed.

Thus, when replacing the recording sheet, there is a necessity of keeping the recording sheet removed. At this time, if, for instance, the photographic sheet is stored in a naked state, the sheet might unpreferably be affected by dusts and external light, and it is therefore troublesomely required that the sheet be inserted back into the original storage bag, etc. and thus stored.

In this respect, the inconvenience described above can be obviated by providing two sheet supply ports respectively for A4-sized plain paper and the L-sized/postcard-sized photographic sheet, also providing independent sheet supplying mechanisms at the respective sheet supply ports, and further respectively incorporating the sheet type discriminating sensors therein. It, however, follows that the manufacturing cost rises and the apparatus is, as a matter of course, upsized.

SUMMARY OF THE INVENTION

It is an object of the present invention to provide a sheet supplying apparatus contrived to prevent the apparatus from being upsized and to reduce a manufacturing cost by employing one sheet supplying/separating mechanism in common that is capable of supplying and separating sheets from both of first and second stacking trays, and to provide a recording apparatus mounted with this sheet supplying apparatus.

It is another object of the present invention to provide a sheet supplying apparatus comprising first stacking means stacked with sheets and including a first stacking portion receiving component force of the gravity in a sheet supplying direction from the sheets, second stacking means installable in a detachable/attachable manner from and to the first stacking means on an upper side in the sheet stacking direction of the first stacking portion, and separating/supplying means used in common to the first stacking means and the second stacking means, for separating and supplying the stacked sheets, wherein the second stacking means includes a base member for installing in the first stacking means, and a second stacking portion movably incorporated into the base member, wherein the second stacking portion is so constructed as to be possible of advancing and retreating substantially in parallel with the sheet supplying direction, and wherein in a retreat position where the second stacking portion retreats upstream in the sheet supplying direction, the sheet can be supplied from the first stacking portion, and, in a possible-of-supplying position where the second stacking portion advances downstream in the sheet supplying direction, the sheet can be supplied from the second stacking portion.

It is a further object of the present invention to provide a sheet supplying apparatus comprising a first stacking portion and a second stacking portion stacked with sheets and receiving component force of the gravity in a sheet supplying direction, and a separating/supplying portion used in common to the first stacking portion and the second stacking portion, for separating and supplying the stacked sheets, wherein the second stacking portion is so constructed as to be possible of advancing and retreating substantially in parallel with the sheet supplying direction with respect to the first stacking portion, and wherein in a retreat position where the second stacking portion retreats upstream in the sheet supplying direction, the sheet can be supplied from the first stacking portion, and, in a possible-of-supplying position where the second stacking portion advances downstream in the sheet supplying direction, the sheet can be supplied from the second stacking portion.

BRIEF DESCRIPTION OF THE DRAWINGS

FIG. 13A shows the release position, and FIG. 13B shows the standby position;

FIG. 14A shows a locked state and FIG. 14B shows an unlocked state;

FIG. 15A shows a case of being in the release position and FIG. 15B shows a case of being in the standby position;

FIG. 16A shows the lock mechanism on the right side (fiducial side), FIG. 16B shows the lock mechanism on the left side (non-fiducial side), and FIG. 16C shows the lock mechanism on the right side (fiducial side) when in the standby position;

DESCRIPTION OF THE PREFERRED EMBODIMENTS

Embodiments of the present invention will hereinafter be described with reference to the accompanying drawings.

Figure 1:
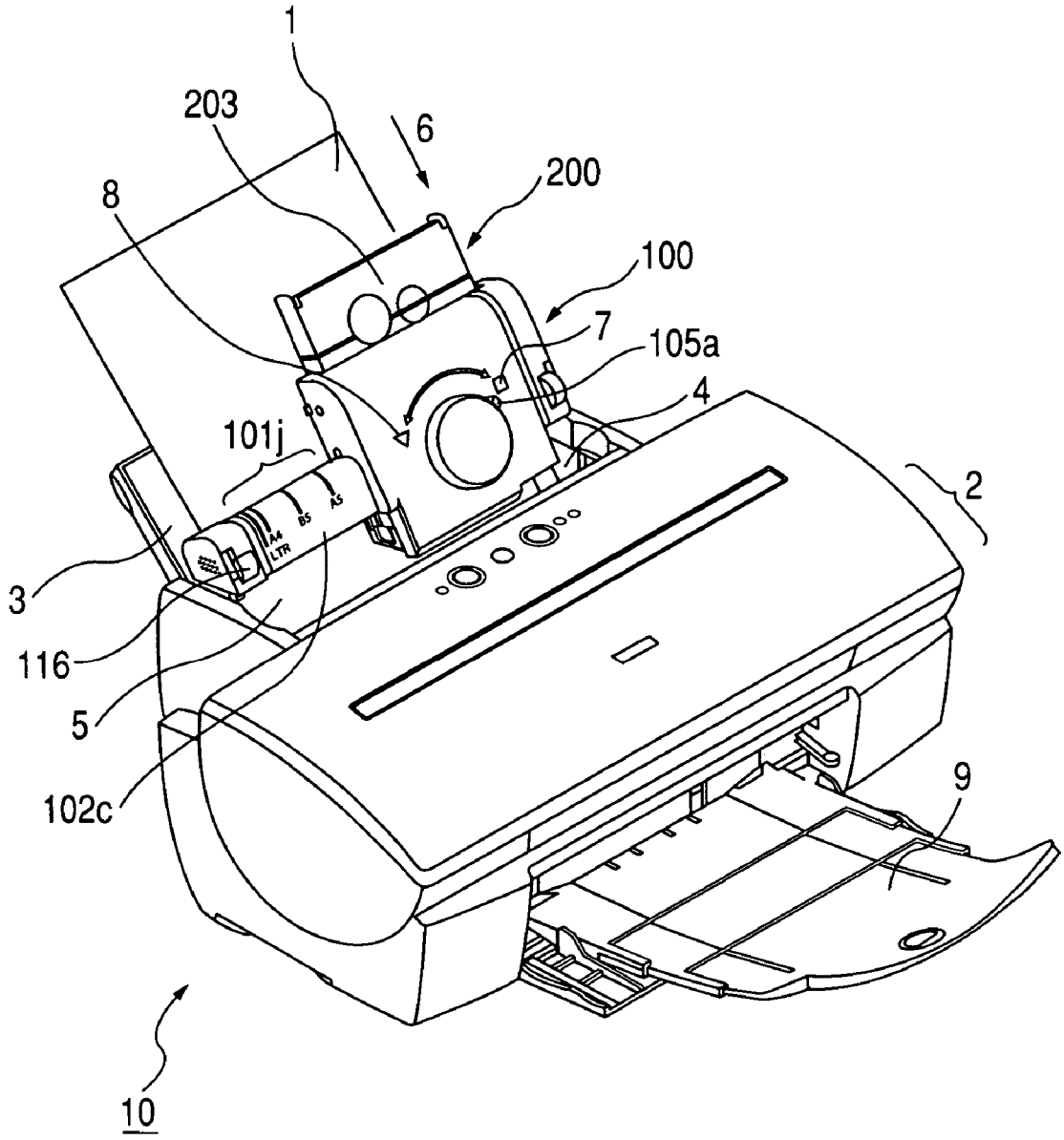
FIG. 1 is a whole perspective view showing a retreat state of a sub supply tray in a printer to which the present invention is applied.

FIG. 1 shows a perspective view of the whole of an inkjet printer as a recording apparatus to which the present invention is applied.

An inkjet printer 10 includes substantially a supply tray 3 serving as a first stacking portion stacked with the recording sheets and receiving component force of the gravity at least in a supply direction (as illustrated in, e.g., FIG. 1, the first stacking portion is inclined in the supply direction of record sheets 1 so that the record sheet 1 is slid down by its self-weight), a supplying apparatus unit 5 serving as a first stacking means having a separating/supplying means capable of separating and supplying the record sheets stacked in bundle on the supply tray 3, a recording unit 2 for recording an image on the record sheet 1, and a sheet discharging tray 9 into which the record sheet recorded with the image is discharged.

The plurality of record sheets 1 can be stacked in bundle on the supply tray 3. The record sheets 1 stacked in bundle on the supply tray 3 are separated sheet by sheet and thus supplied to the recording unit 2 by the supplying apparatus unit 5 (in a direction indicated by an arrowhead 6 in FIG. 1) when operated.

The inkjet printer 10 includes a sub-supply unit 100 (which will hereinafter be also referred to as a "photo deck") serving as a second stacking means for holding a sub-supply tray 200 (which will hereinafter be also called a "photo tray") defined as a second stacking unit that receives component force of the gravity at least in the supply direction. The sub-supply unit 100 is detachably attached to a supplying apparatus unit 5 as the first stacking means substantially in parallel with the supply tray 3 so as to be positioned in front of and upwardly of the inclined supply tray 3.

The sub-supply tray 200 is capable of accommodating a plurality of record sheets for photographs such as an L-size, a postcard, etc. having a comparatively small size. The sub-supply tray 200 is provided with a tray cover 203 (which might hereinafter be simply called a "cover") for shielding the accommodated record sheets from dusts and the external light.

A user is therefore able to load the photographic record sheets into the sub-supply tray 200 by opening the tray cover 203 in a state that the sub-supply unit 100 is detached from the printer 10 or in a state that it is attached to the printer 10 without being detached therefrom.

Note that the supply tray 3 positioned in rear of and downwardly of the sub-supply tray 200 be, it is preferable, stacked with the record sheets as comparatively large-sized sheets used for creating documents such as A4 sized paper, B5 sized paper and so on. FIG. 1 shows such an example. The record sheet 1 is not, however, limited to this type of sheet, and large sized photographic record sheets may also be stacked.

Further, the sub-supply unit 100 is disposed forwards upwardly of the supply tray 3 at a proper interval (which is large enough to enable approximately, for instance, 100 record sheets 1 to be stacked on the supply tray 3) from the supply tray 3. Hence, even in a state where the sub-supply unit 100 is attached, the record sheets 1 can be stacked on the supply tray 3. It is therefore possible to record the image on the record sheet 1 even in such a state.

Figure 6:
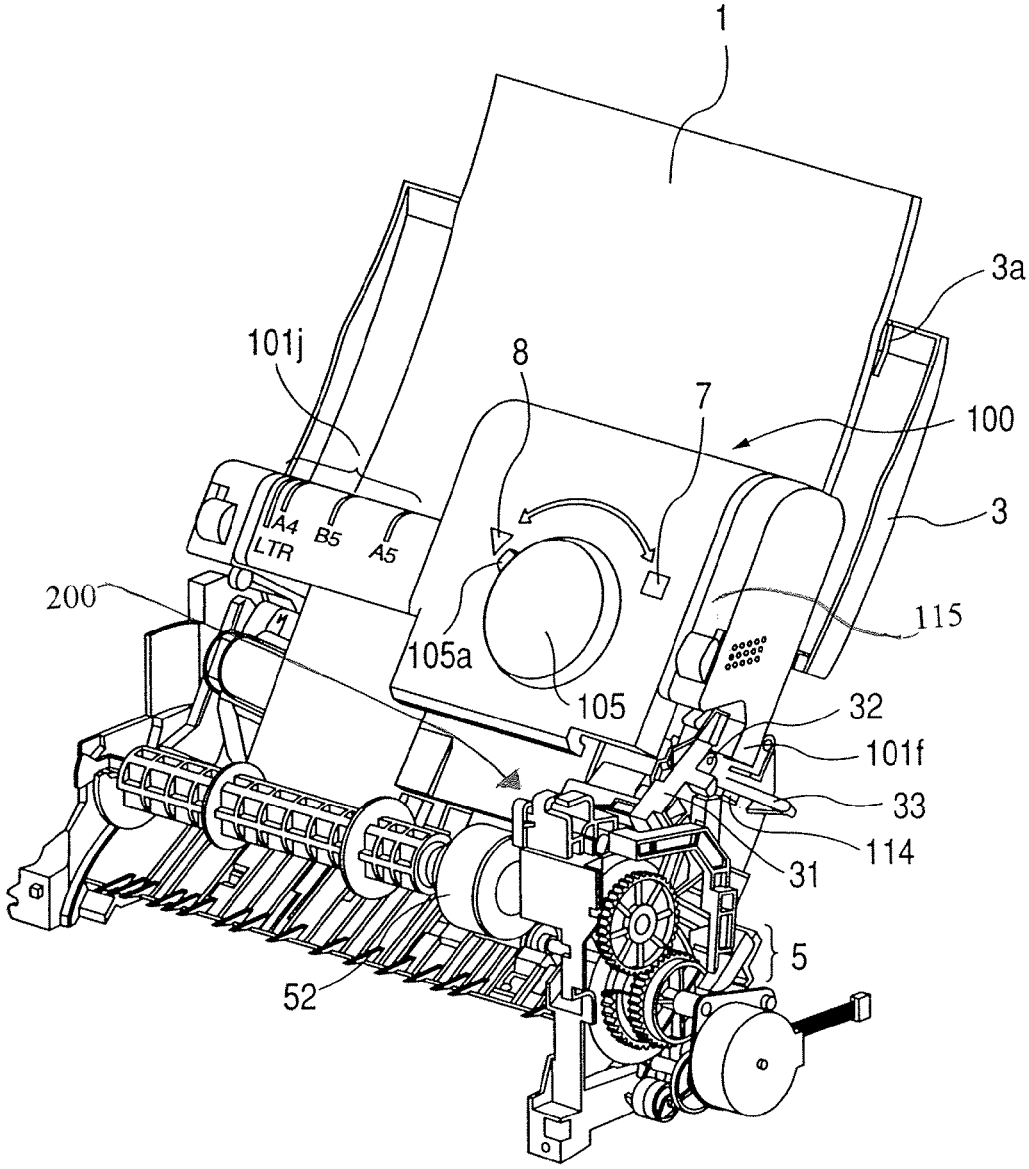
FIG. 6 is a detailed explanatory view of a supply apparatus unit in the embodiment of the present invention.

Incidentally, in a case where the sub-supply unit 100 is attached to the printer 10, as the sub-supply unit 100 is positioned to cover the supply tray 3, when stacking the recording sheets 1 on the supply tray 3, it is difficult to visually recognize a sheet fiducial position marked downstream in a sheet conveying direction 6 normally on the right side of the supply tray 1 in FIG. 1. To obviate this problem, according to the present embodiment, as illustrated in FIG. 1, a suite of indexes 101*j* (the indexes for LTR (letter size), A4 size, B5 size and A5 size are marked in this embodiment, however, the indexes are not limited to the above-mentioned) suited to the sheet sizes, are formed in an arm portion 102*c* provided on the left side of the sub-supply unit 100. This contrivance enables the record sheet 1 to be properly set by adjusting a side end of the record sheet 1 on a non-fiducial side (the left side in the embodiment shown in FIG. 1) to the index 101*j* when the sub-supply unit 100 is properly installed in the printer 10. Alternatively, as illustrated in FIG. 6, if the supply tray 3 is well larger than the sub-supply unit 100, an index 3*a* to which the sheet fiducial position is extended may be formed on an exposed portion of the supply tray 3 on an upstream side in the sheet conveying direction 6. As a matter of course, any one of the index suite 101*j* and the index 3*a* may be provided, and both of these indexes may also be simultaneously provided. Even in the state where the sub-supply unit 100 is installed into the printer 10, the record sheets 1 can be set properly and easily in the supply tray 3 by providing the index suite 101*j* and the index 3*a*.

The printer 10 further includes a sheet type discriminating sensor 4. The sheet type discriminating sensor 4 is constructed to abut on the surface of the record sheet by a proper pressure. The sheet type discriminating sensor 4 optically detects and identifies a surface state of the record sheet before being fed to the recording unit 2. Based on a result of the optical detection and identification, the printer 10 is controlled so as to perform optimum image printing corresponding to a type of the record sheet.

Figure 2:
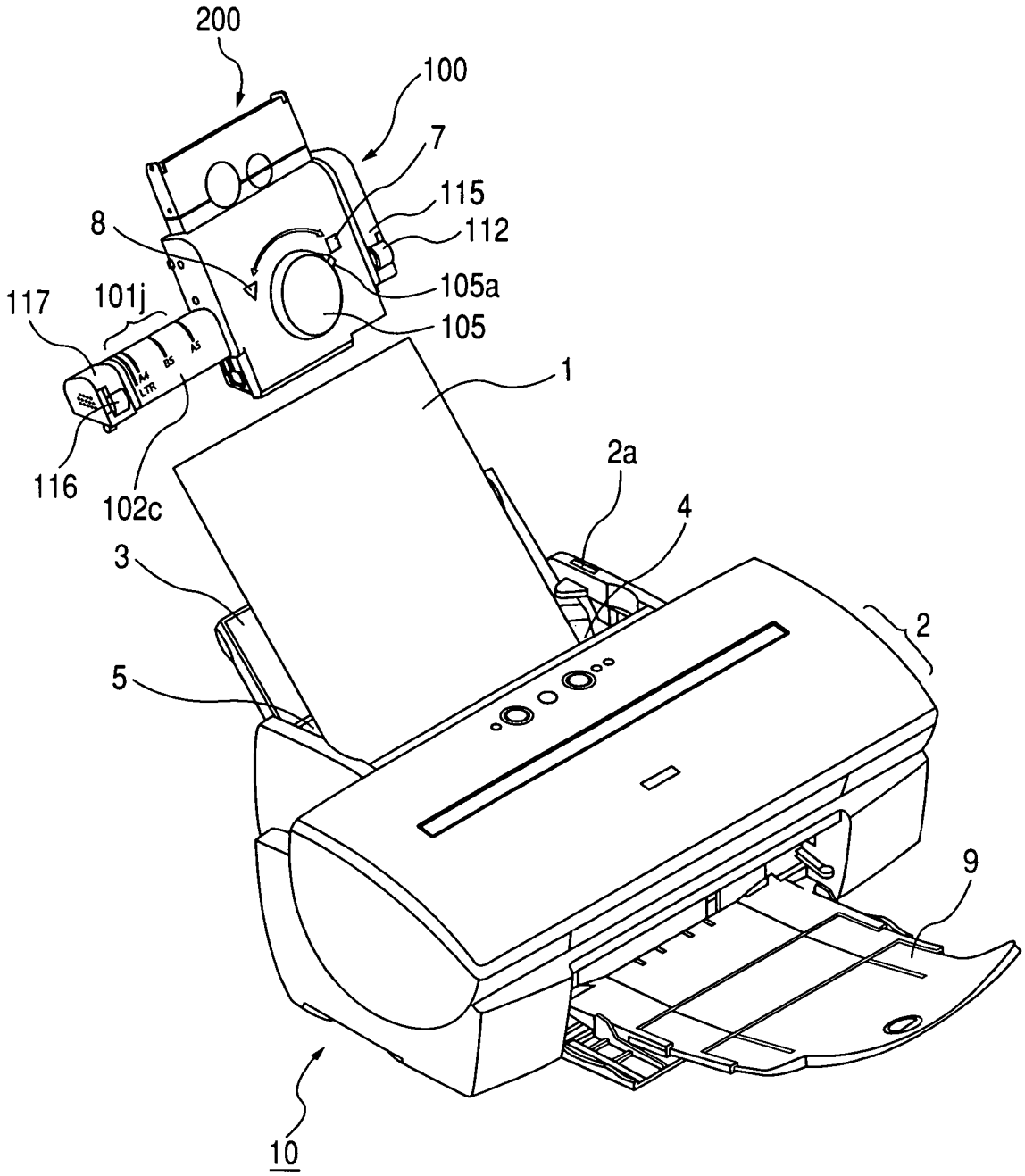
FIG. 2 is an explanatory view showing how a sub supply unit in an embodiment of the present invention is detached.

The sub-supply unit 100 is, as described earlier, so constructed as to be attachable to and detachable from the supplying apparatus unit 5. FIG. 2 illustrates a state in which the sub-supply unit 100 is detached from the supplying apparatus unit 5. The sub-supply unit 100 is detachably attachable while the sub-supply tray 200 accommodates the photographic record sheets. The sub-supply unit 100 has a lock lever L 116 within a side cover L 117 disposed at a left end and a lock lever R 112 within a side cover R 115 disposed at a right end. Engagement portions (which will be described later on) interlocking with these levers engage with the supplying apparatus unit 5, whereby the sub-supply unit 100 is fixed to the printer 10. Conversely when detaching the sub-supply unit 100 from the printer 10, the engagement portions may be disengaged by manipulating the lock lever L 116 and the lock lever R 112.

An operation of the sub-supply unit 100 will be explained referring to FIGS. 1 and 3.

Figure 3:
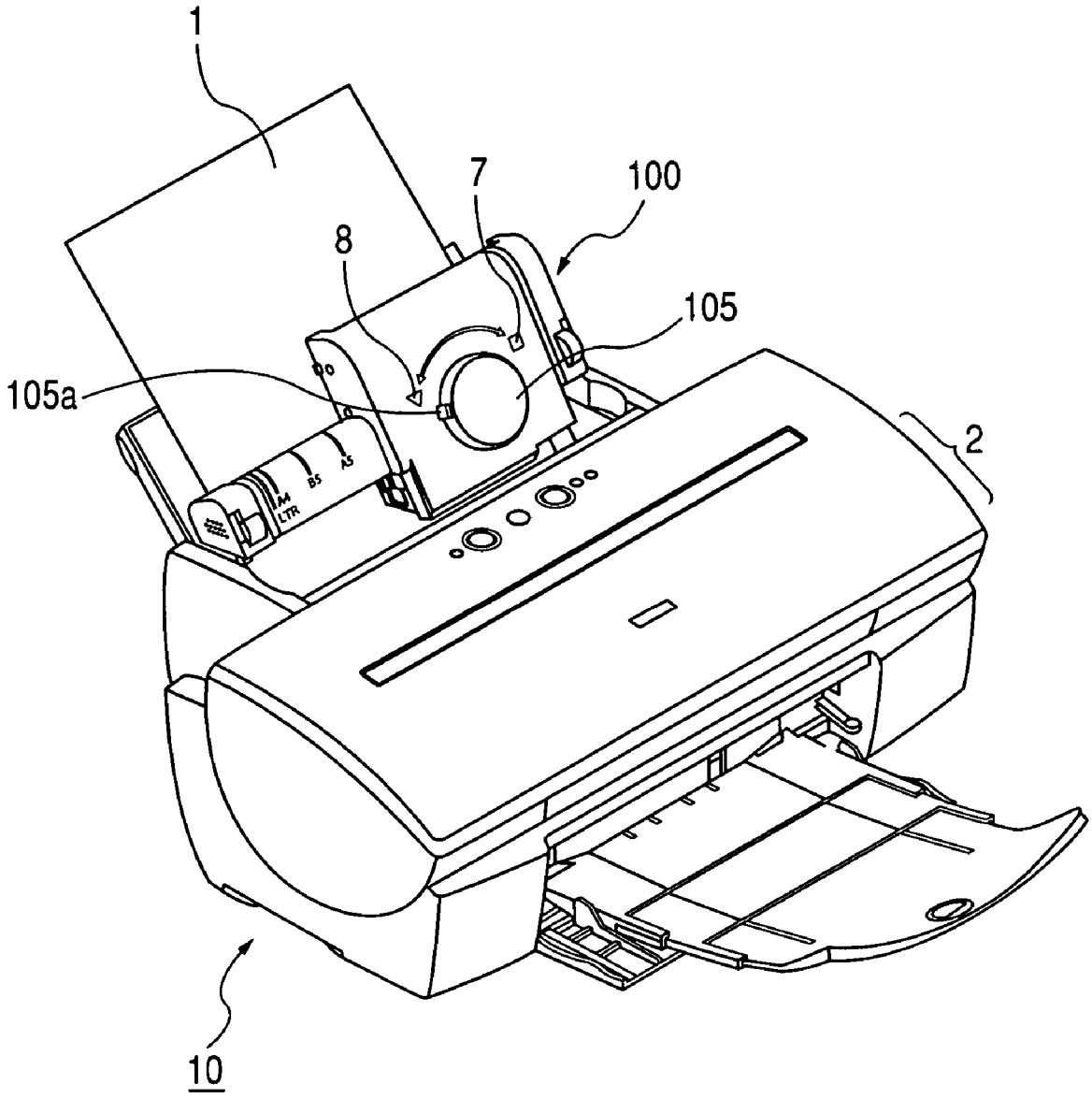
FIG. 3 is a whole perspective view showing a state possible of feeding sheets on the sub supply tray in the printer to which the present invention is applied.

As shown in FIG. 3, a dial type rotational knob 105 (which will hereinafter be also termed a "set lever") is provided on a front portion of the sub-supply unit 100. The rotational knob 105 is manipulated by rotating a knob 105 between two positions, i.e., a position 7 and a position 8 indicated by a projection 105*a* of the rotational knob 105. The rotational knob 105 interlocks with a sub-supply tray drive mechanism which will be described later on. The rotational knob 105 is structured to move the sub-supply tray 200 configuring the sub-supply unit 100 in reciprocation in a direction with an arrowhead 6 (FIG. 1) (the record sheet conveying direction) and in the opposite direction. When the projection 105*a* of the rotational knob 105 is positioned in the position 7 (a state in FIG. 1), the sub-supply tray 200 is in a standby state where the sub-supply tray 200 moves back upstream in the arrowhead 6 direction. When the projection 105*a* is positioned in the position 8 (a state in FIG. 3), the sub-supply tray 200 advances a predetermined distance from the standby state in the arrowhead 6 direction and comes to a record sheet possible-of-supplying state. The discussion further continues with reference to FIGS. 4 to 6 in combination, wherein the above two positions are typified by the position 7 (which will hereinafter be also called a "release position") and by the position 8 (which will hereinafter be also called a "standby position") by way of representation.

Figure 4:
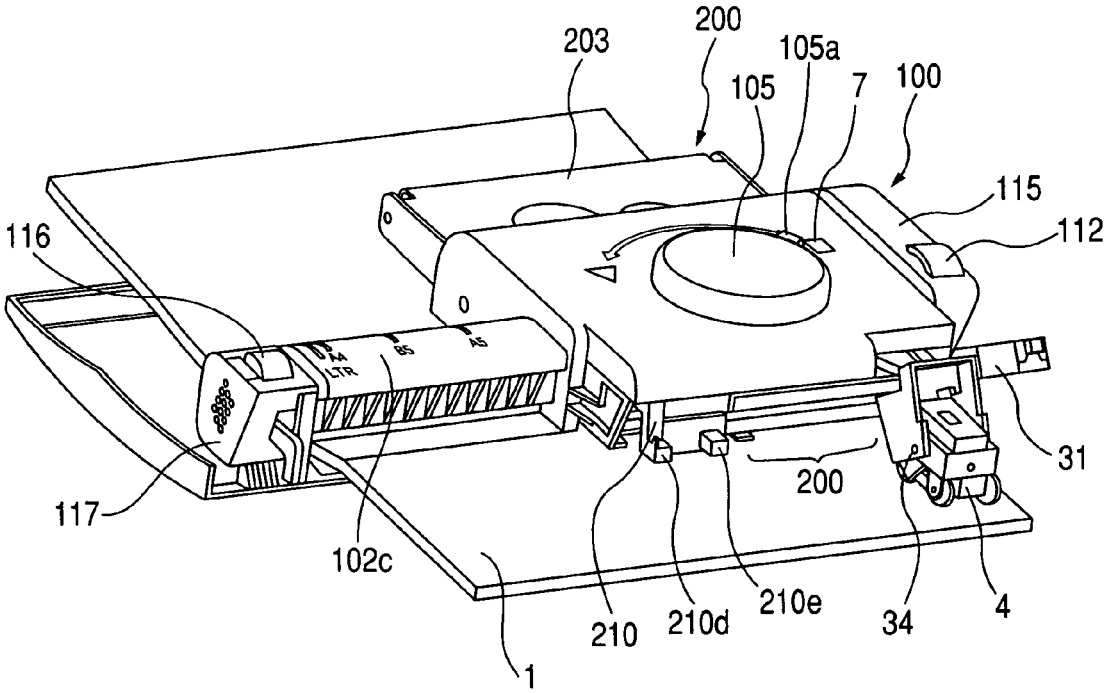
FIG. 4 is an enlarged view of the sub supply unit and a recording sheet type discriminating sensor, showing the retreat state of the sub supply tray in the embodiment of the present invention.
Figure 5:
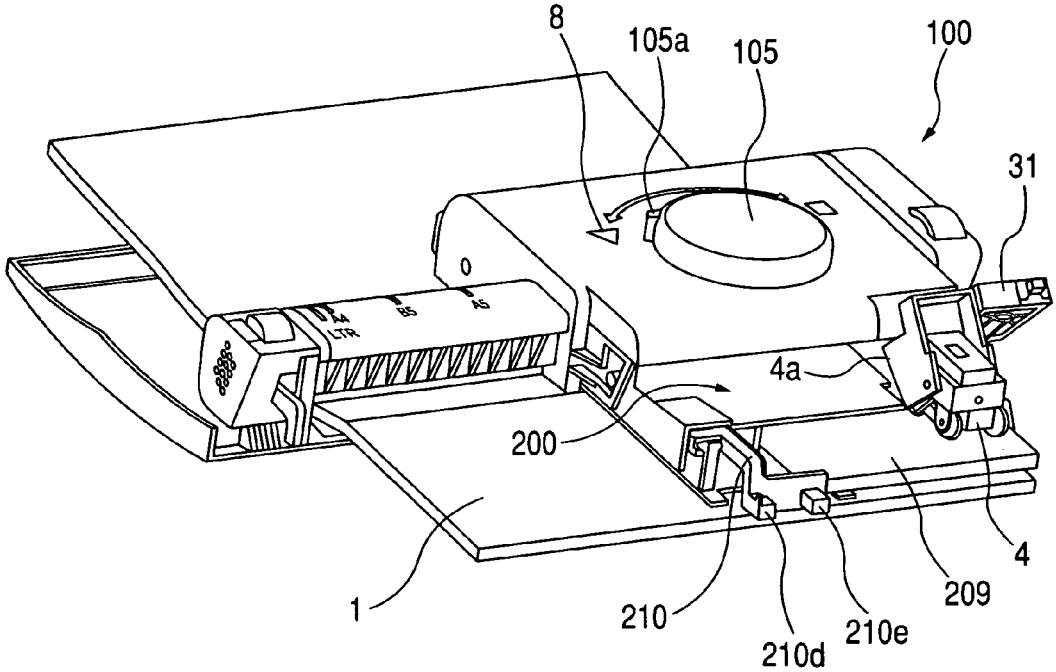
FIG. 5 is an enlarged view of a sub sheet feeding unit and a paper type sensor, showing a state possible of feeding the sheets on the sub sheet feeding tray in the embodiment of the present invention.

FIGS. 4 and 5 are perspective views showing mainly components as extracted parts of the sub-supply unit 100 and of the sheet type discriminating sensor 4. FIG. 6 is a perspective view showing the supplying apparatus unit 5 as an extracted unit.

Referring to FIG. 6, the sheet feeding mechanism for feeding the record sheets 1 in separation sheet by sheet out of the supplying apparatus unit 5 involves the use of a well-known mechanism, and hence an in-depth description thereof is omitted herein. A supply roller 52 for feeding the record sheet is positioned in the vicinity of leading ends of the record sheets stacked on the supply tray 3. The sheet feeding mechanism including the supply roller 52 and a mechanism vicinal thereto is structured to feed the record sheets sheet by sheet in the sequence from the uppermost of a bundle of record sheets stacked thereon.

The sheet type discriminating sensor 4 is rotatably supported on a sensor lever 31 through a shaft portion 34. The sensor lever 31 is rotatably supported on a shaft 32 of the supplying apparatus unit 5. Then, a spring 33 is hooked to the sensor lever 31, and the sensor lever 31 is biased counterclockwise about the shaft 32 in FIG. 6. With this configuration, the sheet type discriminating sensor 4 is closely fitted to the surface of each of the stacked record sheets by a proper pressure in a way that follows up with, even when an amount of the stacked record sheets changes, this change.

Further, a tray position detecting sensor 114 (which is also referred to as a "position sensor") is provided in the supplying apparatus unit 5 and is capable of detecting that the sub-supply tray 200 is in the standby position. In short, though a detailed explanation will be given later on, a lever member (which is not illustrated in FIG. 6 but is understandable by referring to a position sense link lever 111 in FIGS. 15A and 15B) provided in a leg portion 101*f* of the side cover R 115 of the sub-supply unit 100 is protruded from the leg portion 101*f* only when in the standby position by use of a well-known link mechanism that operates interlocking with an operation of the sub-supply tray 200, and the protruded lever member is detected by the tray position detecting sensor 114. The tray position detecting sensor 114 may be of either an optical type of interrupter or a mechanical contact type.

Owing to such a construction, the sub-supply unit 100 is detachably attachable to the supplying apparatus unit 5 of the printer 10, and it is possible to detect the position of the sub-supply tray 200 and the type of the sheets in the sub-supply tray. An electrical contact and electric parts for the detection do not exist on the side of the sub-supply unit 100 to be removed, and hence there is actualized a mechanism enabling the sub-supply unit 100 to be provided with none of wiring, etc. for transmitting the electrical signals.

FIG. 4 shows a state when in the release position, wherein the sub-supply tray 200 retreats backwards as described above. At this time, the sheet feeding mechanism including the supply roller 52, etc. acts on the record sheet 1 stacked on the supply tray 3, whereby the record sheets 1 are supplied from the supply tray 3 serving as the first stacking portion for the record sheets 1. Further, at this time, the sheet type discriminating sensor 4 abuts on the uppermost surface of the stacked record sheets 1 and is therefore capable of discriminating between the types of the record sheets at this portion.

Next, the discussion will be made with reference to FIG. 5. FIG. 5 shows the state when in the standby position, wherein the sub-supply tray 200 moves up to the record sheet possible-of-supplying position and is position forwards. At this time, the leading end of the bundle of stacked photographic record sheets 209 accommodated in the sub-supply tray 200 is so positioned as to be substantially coincident with the leading end of the record sheets 1 stacked on the supply tray 3. In this state, operation force of the sheet feeding mechanism including the supply roller 52, etc. on the occasion of supplying and separating the record sheets by this mechanism, acts on the photographic record sheets 209, whereby the photographic record sheets 209 are separated sheet by sheet and thus fed out.

At this time, the sheet type discriminating sensor 4 also abuts on the uppermost surface of the photographic record sheets 209 and is thereby capable of discriminating between the sheet types. Further, as already described, the tray position detecting sensor 114 can detect that the sub-supply tray 200 is in the standby position. In other words, according to this embodiment, in the standby position, it is possible to recognize in a correlated manner that the sheet is supplied from on the sub-supply tray 200 through by the tray position detecting sensor 114 and that the sheet to be supplied is the photographic record sheet through by the sheet type discriminating sensor 4. While on the other hand, in a reversed case, i.e., in the case of the release position, it is feasible to recognize in the correlated manner that the tray position detecting sensor 114 does not detect the sub-supply tray 200 and therefore the sheet is supplied from the supply tray 3 and that the sheet type discriminating sensor 4 identifies the sheet to be supplied with the record sheet 1.

When shifting to the standby position from the release position, the leading edge of the photographic record sheet 209 advances resisting a pressure given from the aforementioned spring 32 while abutting on an inclined surface portion 4*a* of the sheet type discriminating sensor 4, and it follows that the sheet type discriminating sensor 4 moves upwards corresponding to an amount (thickness) of insertion of the photographic record sheet 209. The operation of this sheet type discriminating sensor 4 is, in a state of the release position, the same as when replenishing the record sheets to the supply tray 3 disposed downwards, and the leading end of the inserted record sheet abuts on the inclined surface 4*a* of the sheet type discriminating sensor 4 and is raised corresponding to the thickness of the record sheet.

Owing to such a configuration, the same sheet feeding mechanism can separate and supply both of the record sheets 1 and the photographic record sheets 209, and the same sheet type discriminating sensor can discriminate between the types of both of the record sheets 1 and of the photographic record sheets 209.

Next, a construction of the sub-supply unit serving as a second stacking means, viz., a photo deck 100 will be explained in detail with reference to the drawings.

In this embodiment, the photo deck 100 dedicated to small-sized sheets is so provided as to be attachable to and detachable from a main body of the printer. The photo deck 100 is, when attached to the main body of the printer, positioned at the supplying apparatus unit and is disposed substantially in parallel with and upwardly of the supply tray 3 of the supplying apparatus unit and of the record sheets 1 stacked on the supply tray 3. The photo deck 100 has a structure that enables the selection, by the simple lever manipulation, of the two positions, i.e., the standby position capable of supplying the stacked recording sheets 1 to the photo deck 100 and recording on the record sheet 1, and the release position in which the record sheet stacked in the supplying apparatus unit of the main body of the printer is supplied (namely, the photo deck is supplied of none of the stacked record sheets) and the record sheet 1 is subjected to recording. Further, the photo deck 100 does not include a driving source and takes a configuration employing the driving force and the separation mechanism of the supplying apparatus unit provided in the main body of the printer. With this contrivance, the printer according to the present invention has the simple construction, compactness, low-cost performance and usability in combination.

According to the present embodiment., the photo deck has the structure flexibly adaptable to record sheet sizes such as an L-sized photographic sheet size, a panorama photographic sheet size, a government-printed postcard size, and a size of 4×6 in. (a size of approximately 101.6×152.4 mm).

The construction of the photo deck 100 will hereinafter be explained in conjunction with the drawings.

Figure 7:
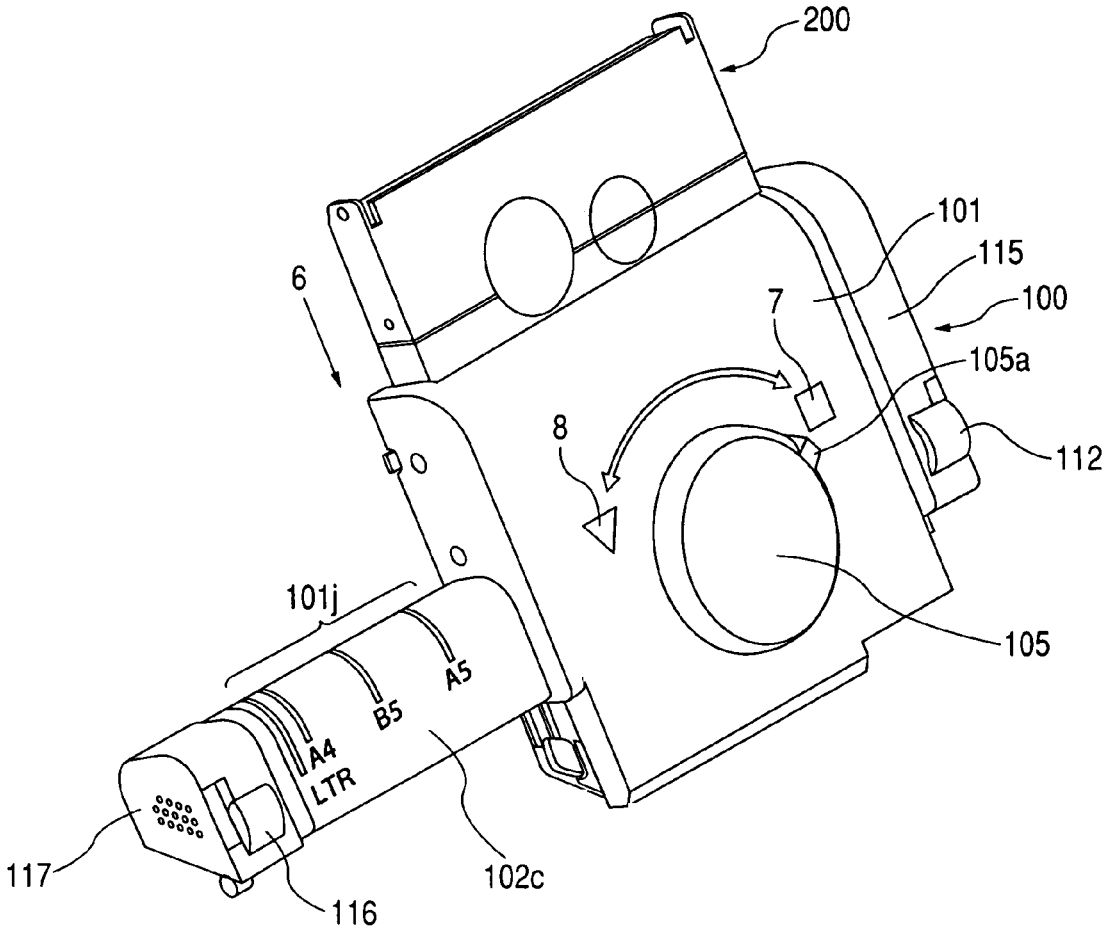
FIG. 7 is an explanatory perspective view showing the whole of a photo deck in the embodiment of the present invention.
Figure 8A:
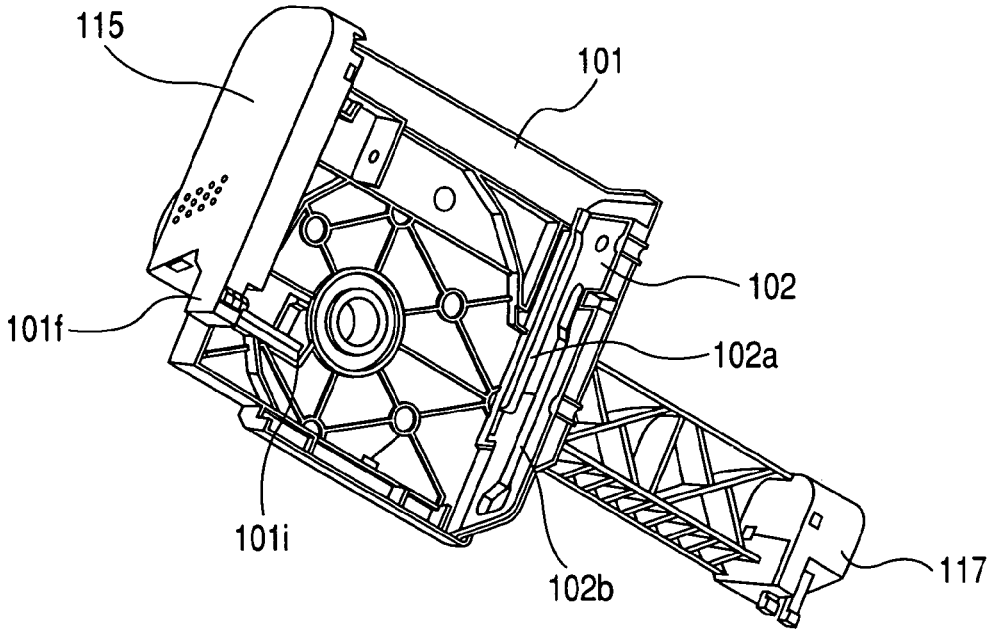
FIGS. 8A and 8B are explanatory perspective views of the underside of the photo deck in a state where a photo tray is detached in the embodiment of the present invention, and they are views showing the same as viewed at different angles, respectively.
Figure 8B:
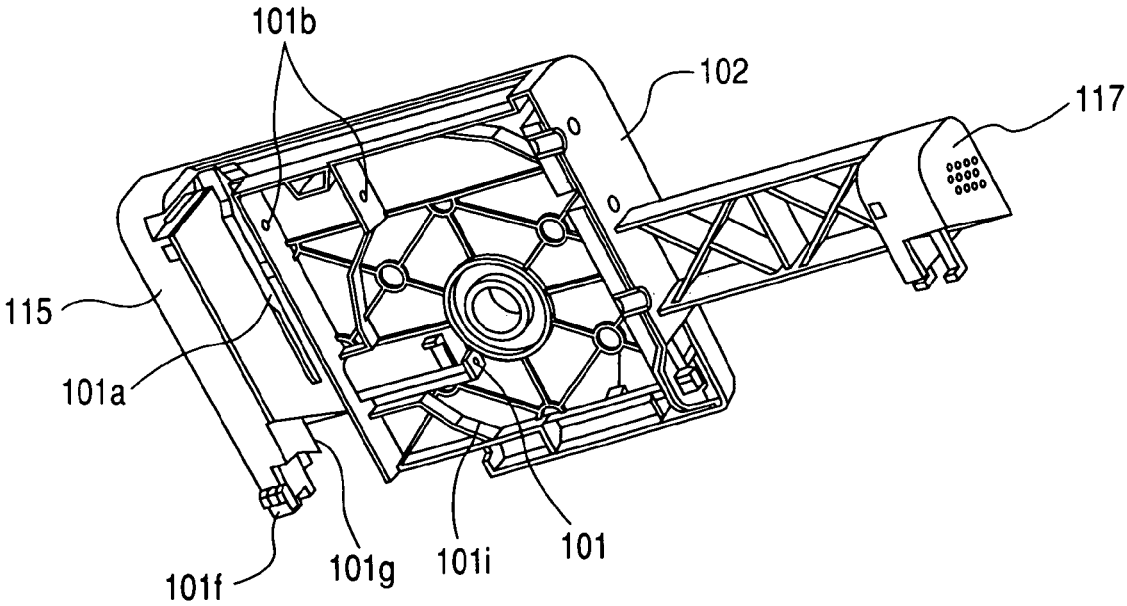
Figure 9A:
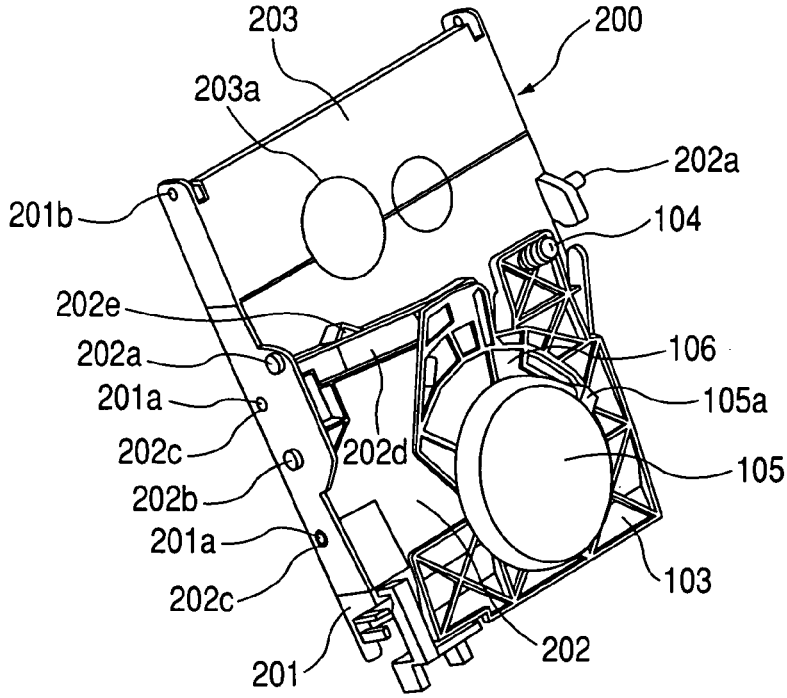
FIGS. 9A and 9B are explanatory perspective views showing the photo tray, a manipulation knob, etc. in a release position in the embodiment of the present invention, and they are views showing the same as viewed from the surface side and the underside, respectively.
Figure 9B:
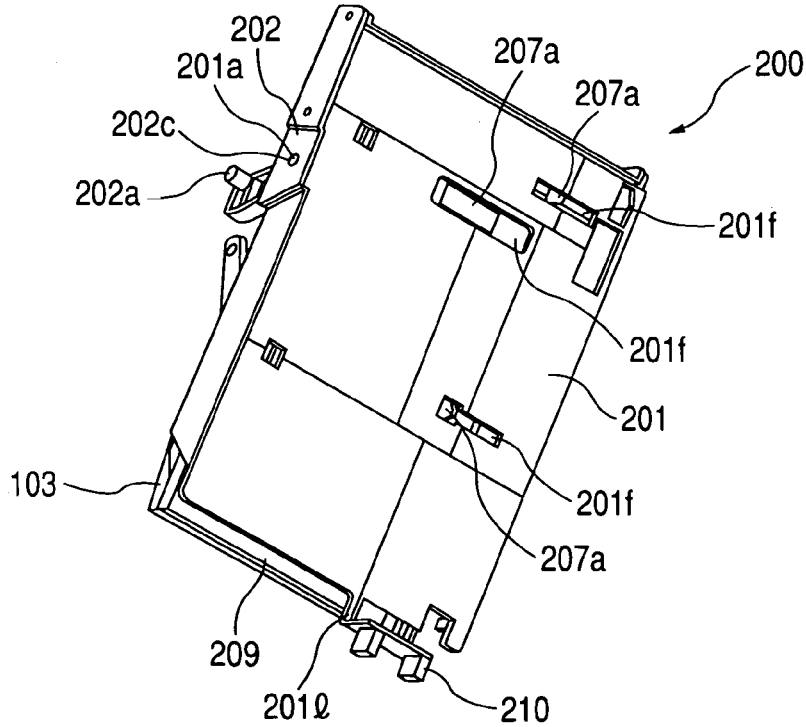
Figure 10:
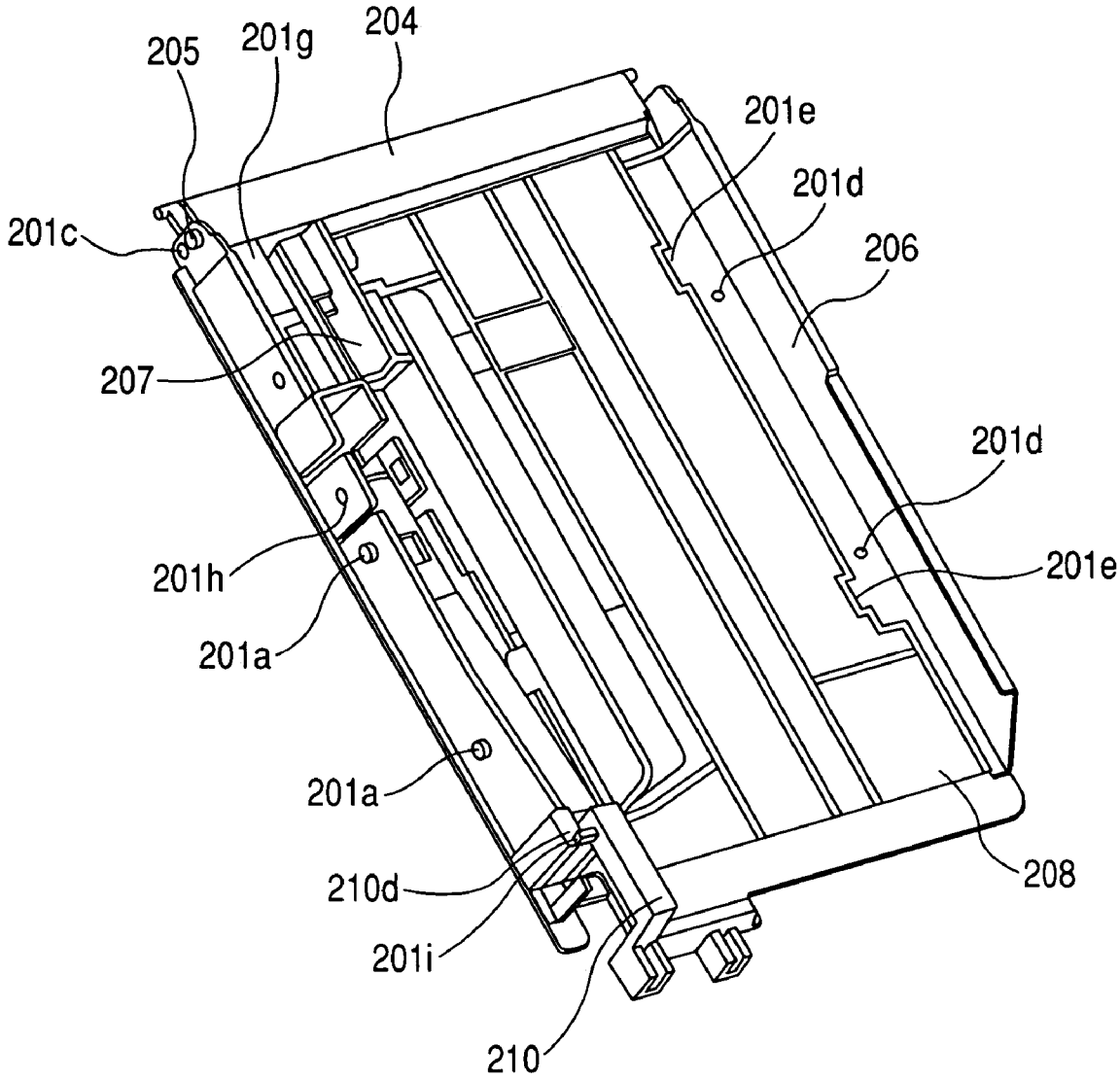
FIG. 10 is an explanatory perspective view showing a lower side of the photo tray in the embodiment of the present invention.
Figure 11:
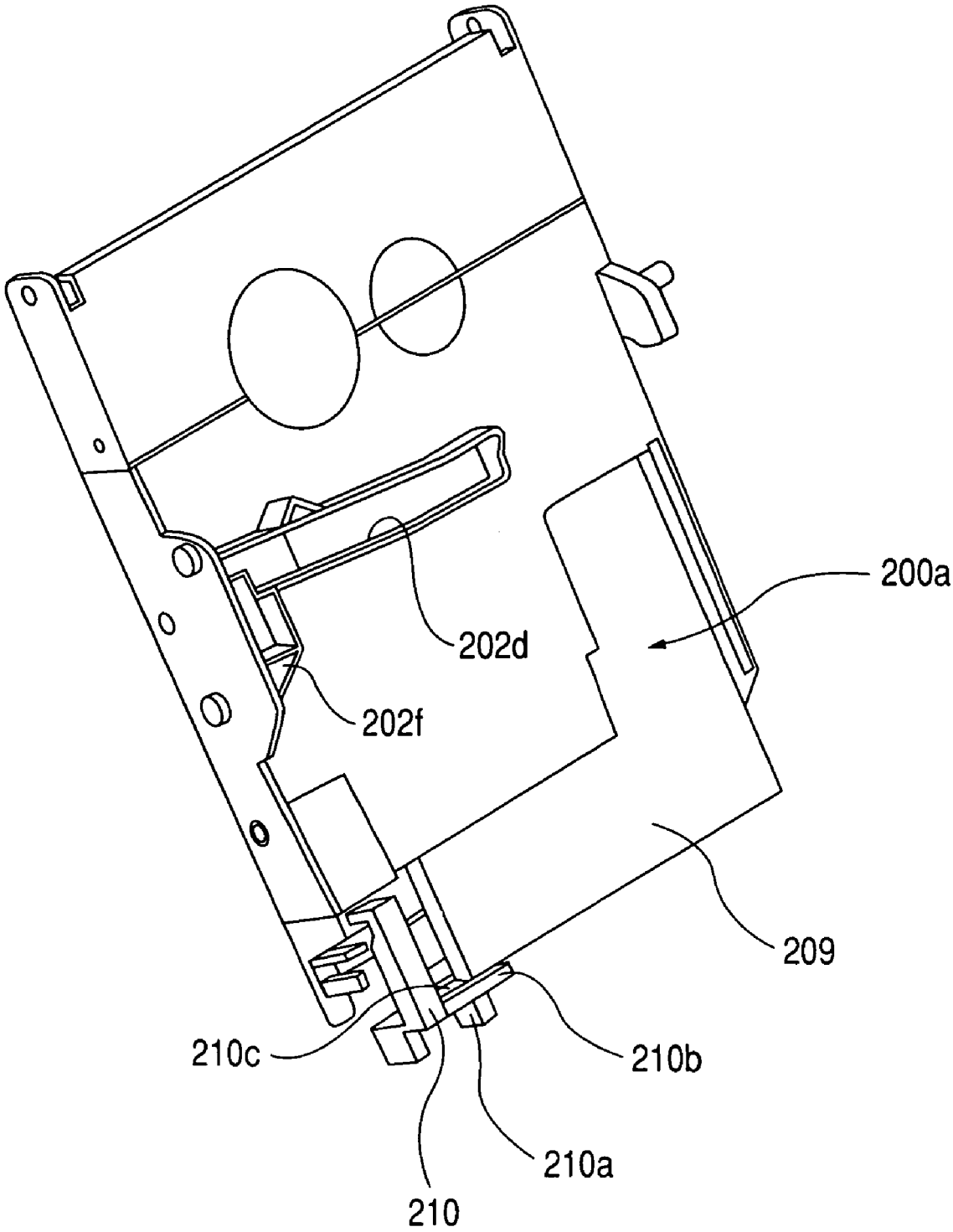
FIG. 11 is an explanatory perspective view showing the photo tray in the embodiment of the present invention.
Figure 12:
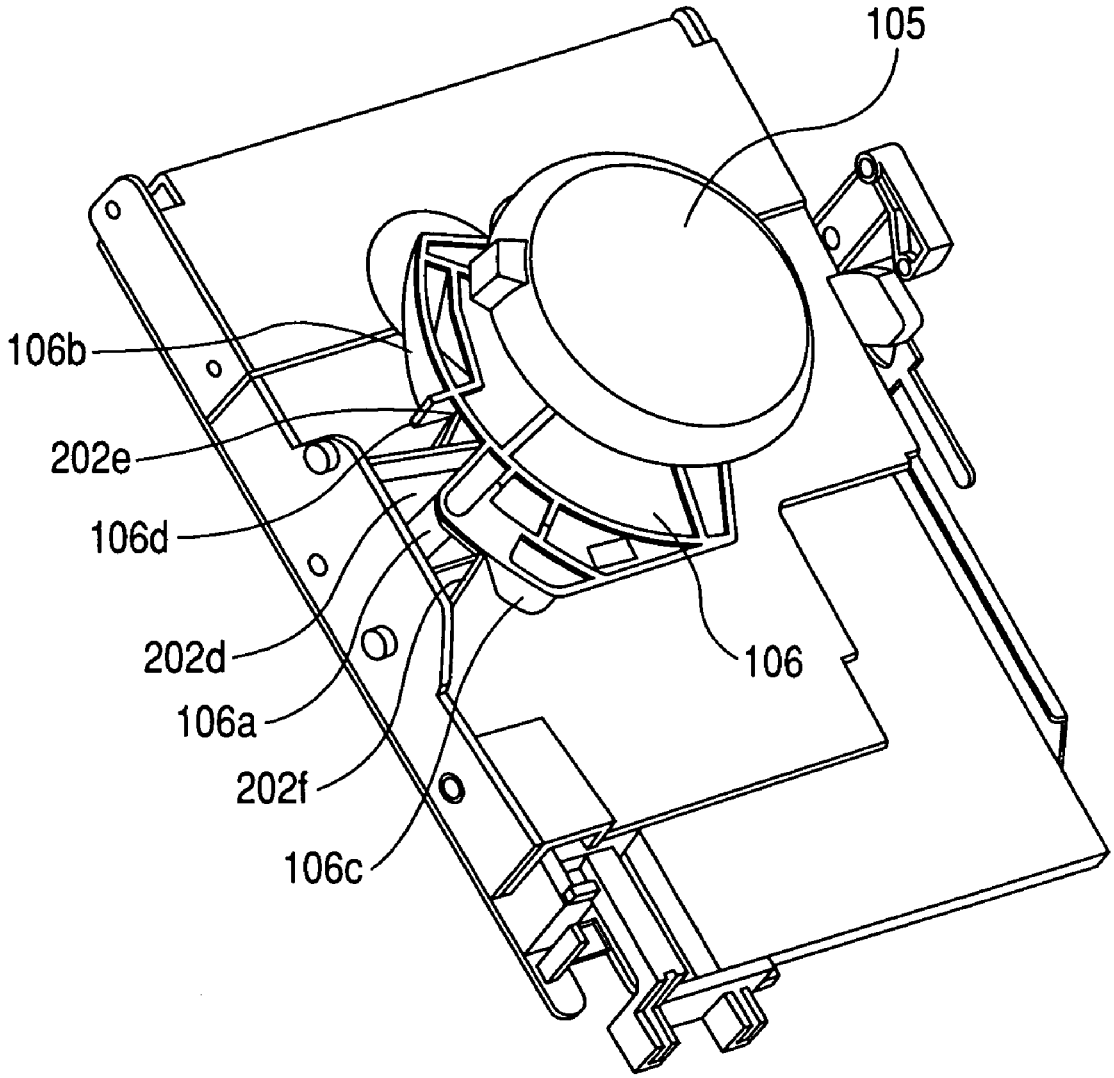
FIG. 12 is an explanatory perspective view showing the photo tray and the manipulation knob in a standby position in the embodiment of the present invention.
Figure 13A:
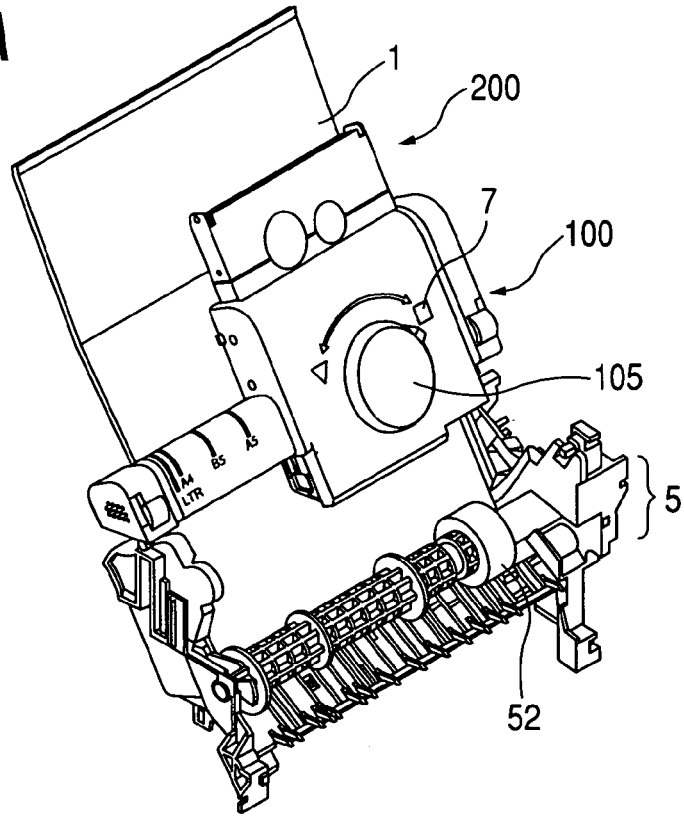
FIGS. 13A and 13B explanatory perspective views showing a supplying apparatus unit and the photo deck of a main body of a recording apparatus in the embodiment of the present invention.
Figure 13B:
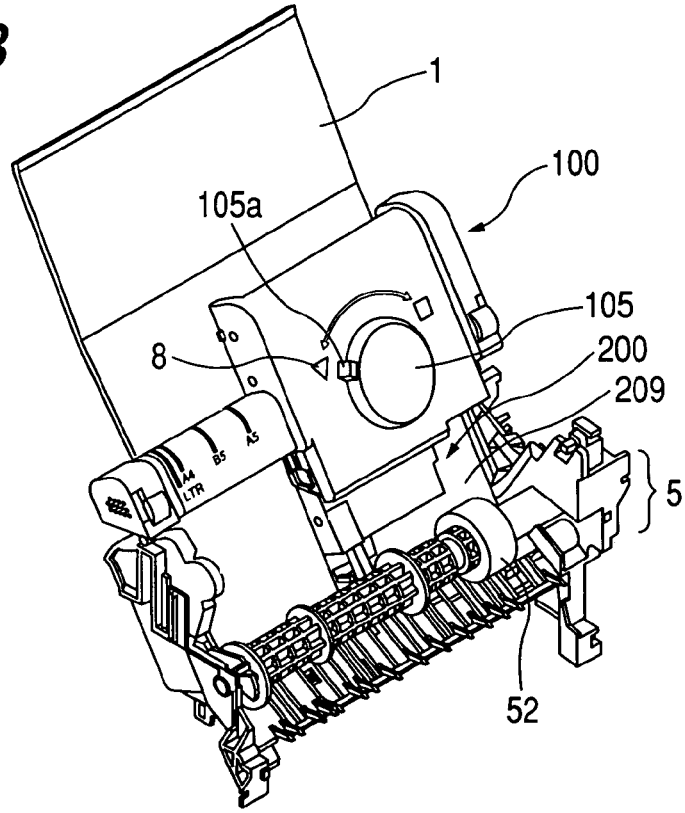

FIG. 7 is a perspective view showing the whole of the photo deck 100. FIGS. 8A and 8B are perspective views showing a state where the sub-supply tray, i.e., the photo tray 200 is removed. FIGS. 9A and 9B are perspective views showing the photo tray 200, a manipulation knob, etc. in the release position as viewed respectively from the surface side and the underside thereof in order to explain a relationship therebetween. FIG. 10 is a perspective view showing a lower case 201 of the photo tray 200. FIG. 11 is a perspective view showing the photo tray 200. FIG. 12 is a perspective view similar to FIG. 9A, showing the photo tray 200, the manipulation knob, etc. in the standby position as viewed from the surface side thereof in order to explain the relationship therebetween. FIGS. 13A and 13B are perspective views showing the release position and the standby position in a way that extracts the supplying apparatus unit 5 and the photo deck 100 of the main body of the printer 10.

The photo deck 100 principally includes a photo deck base 101, the side cover R 115, a left side wall portion 102, an arm portion 117*a* connected to the left side wall portion 102, the side cover L 117 and the photo tray 200.

The photo deck base 101, as illustrated in FIG. 7, cooperates with the side cover R 115 and the left side wall portion 102, thus configuring a box unit in which the photo tray 200 can reciprocate.

The photo deck base 101 is, through the side cover R 115 and the side cover L 117, positioned and attached to the supplying apparatus unit 5 of the main body of the printer 10. Further, a guide groove 101*a* and guide grooves 102*a*, 102*b* engaging with bosses projecting on both sides of the photo tray 200 that will be described later on, are respectively formed in an inside wall 115*a* of the side cover R 115 of the photo deck base 101 and in an inside wall of the left side wall portion 102 fitted to the photo deck base 101, which is positioned in the vicinity of the center thereof. Accordingly, the photo tray 200 is supported on the photo deck base 101 through the guide grooves 101*a*, 102*a* and 102*b*. Besides, the bosses of the photo tray 200 are guided along the grooves 101*a*, 102*a*, 102*b*, whereby the photo tray 200 can move forwards to and backwards from the supplying apparatus unit 5 of the printer 10.

The guide groove 101*a* is formed in the inside wall of the side cover R 115 of the photo deck base 101. Totally two lines of grooves, i.e., the guide groove 102*a* paired with the guide groove 101*a* and the guide groove 102*b* extending in parallel with the guide groove 102*a*, are formed in the inside wall of the left side wall portion 102. One pair of guide grooves 101*a*, 102*a* taking a symmetric shape are the guide grooves along which a pair of bosses 202*a*, as described in FIG. 9A, provided on the right and left sides of the photo tray 200 and serving as a center of rotation make movements. On the other hand, another line of groove 102*b*is the guide along which a boss 202*b* for regulating the rotation of the photo tray 200 moves. The guide grooves 102*b* for regulating the rotation of the photo tray 200 broadly expands in its groove space at a downstream portion in the conveying direction. Owing to this configuration, a posture (rotation) of the photo tray 200 is regulated in the release position and midway of the movement between the release position and the standby position. After moving to the standby position, however, the posture regulation of the photo tray 200 is canceled. Namely, in the standby position, the photo tray 200 becomes rotatable about the pair of bosses 202*a* as the rotational center.

Note that each of the side cover R 115, the side cover L 117 and the left side wall portion 102, as understandable from FIGS. 8A and 8B, takes a dual wall structure including a hollowed portion.

The photo tray 200 is constructed of a lower case 201 assuming substantially a U-shape with its upper portion opened, an upper case 202 assuming substantially a U-shape with its lower portion opened and a cover 203. Each of the lower case 201 and the upper case 202 is molded of a synthetic resin. Bosses 201*a* (two pairs of bosses 201*a* are formed as illustrated in FIG. 9A in this embodiment) are provided on both sides of the lower case 201. (Two pairs of) Holes 202*c* are formed on both sides of the upper case 202. The bosses 201*a* engage with the holes 202*c* by snap action, whereby the lower case 201 and the upper case 202 become integral to configure an angular box body with its upper and lower sides covered. One piece of boss 202*a* is formed outwardly of the side plate on the right side (fiducial side) of the upper case 202. Further, totally two pieces of bosses 202*a*, 202*b* are provided outwardly of the side plate on the left side (non-fiducial side). One boss 202*a* is provided in a symmetrical position with respect to the boss 202 formed on the side plate on the right side. The other single boss 202*b* is provided downstream in the record sheet conveying direction. These bosses 201*a*, 202*a*, 202*b* are, as described above, fitted in the guide grooves 101*a* and the guide grooves 102*a*, 102*b* of the photo deck base 101 and slide along these grooves.

The cover 203 is so attached to an upstream end of the lower case 201 in the record sheet conveying direction as to be rotatable about a pair of shafts 201*b* provided on both sides of the lower case. The cover 203 is, when closed, structured to cover the upper side of the stacked photographic record sheets 209 together with the upper case 202. The cover 203 takes a charge of function of preventing the dusts, etc. from being deposited on the surface of the photographic record sheets 209 set in the photo tray 200.

A top cover 204 (see FIG. 10) is so attached in the vicinity of an upstream end of the lower case 201 in the record sheet conveying direction as to be rotatable about the pair of right-and-left holes 201*c* as the rotational center that are formed on both sides of the lower case 201. The top cover 204 is always biased by a top cover spring 205 in an opening direction. A front end portion of the top cover 204 is contrived to abut on an internal surface of the cover 203 (see FIG. 9A), and hence the top cover 204, when the cover 203 is opened, acts to assist this opening operation. With the construction described above, when opening the cover 203, the top cover 204 likewise opens interlocking therewith, and, when closing the cover 203, the top cover 204 likewise closes interlocking therewith.

A photo deck side plate 206 is attached to an internal portion in the vicinity of the right side wall of the lower case 201. The photo deck side plate 206 takes substantially an L-shape in section, and an internal side of a vertical portion of this plate 206 forms a fiducial-side wall of the photo tray 200, thereby determining a widthwise fiducial position of the photographic record sheets 209 stacked on the photo tray 200. The photo deck side plate 206 is composed of an SUS sheet metal that is 0.5 mm in plate thickness. A horizontal portion of this plate 206 is positioned at the lower case 201 by use of a positioning mechanism 201*d*, 201*e*, and a vertical portion thereof is covered with the upper case 202, whereby the plate 206 is prevented from rotating and coming off and is fixed within the photo tray 200. The positioning mechanism 201*d*, 201*e* may, as exemplified in this embodiment, be constructed of engagement pieces protruding from the horizontal portion of the photo deck plate 206 and recessed portions formed corresponding to the horizontal portion and the securing piece of the photo deck plate 206 which are formed on the lower case 201 so as to receive the horizontal portion and the securing piece thereof. Alternatively, the positioning mechanism 201*d*, 201*e* may also be constructed of securing pieces protruding from the horizontal portion of the photo deck plate 206 and bent downwards and holes formed in the lower case 201. The components of the positioning mechanism are not, however, limited to those.

A photo deck side guide 207 is attached to the lower case 201 slidably in the record sheet widthwise direction. An engagement protruded portion 207*a* of the photo deck side guide 207 engages with an elongate hole 201*f* formed in the lower case 201, whereby the photo deck side guide 207 becomes slidable in the widthwise direction within the lower case 201 (see FIG. 9B). Part of the undersurface of the photo deck side guide 207 is formed with a saw-toothed rugged portion (not shown). The photo deck side guide 207, by dint of elastic force retained in the photo desk side guide 207 itself, engages with a saw-toothed rugged portion formed on the lower case 201, thereby restraining a movement after being slid. The photographic record sheets stacked on the lower case 201 are guided widthwise by the photo deck side guide 207 in cooperation with the photo deck side plate 206, and a widthwise backlash of the photographic record sheets 209 within the photo tray 200 can be restrained.

A white fiducial portion 208 is provided on the lower case positioned facing the sheet type discriminating sensor 4 that will hereinafter be described. The white fiducial portion 208 is used for taking a white fiducial mark serving as a reading level by the sheet type discriminating sensor 4, and is also used for detecting that the record sheets disappear from on the photo tray 200 by utilizing a difference in reflectance between the white fiducial portion 208 and the surface of the photographic record sheets 209 stacked on the photo tray 200.

The photographic record sheets 209 are stacked on the lower case 201. According to the present embodiment, the photographic record sheet 209 is L-sized photographic glossy paper. The downstream side end of the photographic record sheet 209 in the conveying direction can abut on a sheet receiving surface (abutting surface) as a record sheet stacking portion 210*a* (see FIG. 11), extending in the sheet widthwise direction, of the lever 210 that will be explained later on (FIG. 10). An upper stage protruded portion 210*b* and a lower stage protruded portion 210*c*, which are higher by one step (i.e., protrude towards the sheet 209 from the abutting surface) than the abutting surface of the record sheet stacking portion 210*a*, are provided upwardly and downwardly of the record sheet stacking portion 210*a* in the record sheet thicknesswise direction in order to prevent the stacked photographic record sheets 209 from coming off in the vertical direction.

The lever 210 constituting a sheet supply route blocking means is rotatably fitted through a shaft in a hole 201*h* (see FIG. 10) formed in the left side wall of the lower case 201. The lever 210 is also biased by a lever spring (unillustrated) towards the upper case 202 (counterclockwise about the hole 201*h*) in FIG. 10), however, a portion 210*d* of the lever 210 abuts on a stopper portion 201*i* of the lower case 201, whereby the rotation thereof is regulated.

In the release position where the sheets are not supplied from the photo tray, the record sheet stacking portion (the abutting portion) 210*a* of the lever 210 abuts on the end portion of the photographic record sheets 209 downstream in the conveying direction of the sheets 209 so as to block the conveying route (the supply route) for the photographic record sheets 209 set in the photo tray 200, thereby preventing the photographic record sheets 209 from coming off the cassette. On the other hand, though explained later on, in the standby position, the abutting portion 210*a* of the lever 210 is constructed to separate away from the photographic record sheets 209 and to, when supplying the sheets, open the passage route for the photographic record sheets 209 supplied from the photo tray 200.

The front cover 103 (see FIG. 9A, 9B) is rotatably fitted in the hole 101*b* (see FIG. 8A, 8B) formed in the undersurface of the photo deck base 101. The front cover 103 is biased by the front cover spring 104 to rotate towards (upwards) the photo deck base 101 about the hole. Though described later on, when the photo tray 200 is in the release position, the front cover 103 covers an L-shaped aperture 200*a* (FIG. 11) of the photo tray 200, thereby preventing the dusts, etc. from depositing on the surface of the photographic record sheets 209 set in the photo tray 200.

A rotation knob, i.e., a set lever 105 (see FIG. 12) is fastened to a set arm 106 with the photo deck base 101 (see FIG. 8A, 8B) interposed therebetween. The set lever 105 and the set arm 106 engage with each other at their recessed/protruded portions so as not to deviate in their positions in the rotating direction, and are prevented from being removed in a thrust direction by a snap fit. A set lever spring (unillustrated) is provided between the set arm 106 and the photo deck base 101, and always biases the set arm 106 towards the photo tray 200, thereby fastening it with no backlash. Hence, the set lever 105 fastened to the set arm 106 is pressed against a top plate 101*a* (see FIG. 8B) of the photo deck base 101. The set lever 105 is, however, so structured as to be rotatable (swayable) in reciprocation on the top plate 101*a* through a range of totally 124°, i.e., through 62° respectively in the right and left directions with respect to the central axial line perpendicular to the top plate 101*a*. The 124° angle range of rotation of the set lever 105 is an angle for actualizing operability that is preferably in terms of human engineering.

When the set lever 105 is rotated at the maximum in the left direction (counterclockwise) up to the position 8, as illustrated in FIGS. 3 and 13B, the photo tray 200 advances within the record sheet stacking space in the supplying apparatus unit 5 of the main body of the printer 10, and takes the standby position possible of supplying the photographic record sheets 209 stacked on the photo tray 200. While on the other hand, when the set lever 105 is rotated at the maximum in the right direction (clockwise) up to the position 7, as illustrated in FIGS. 1 and 13A, the photo tray 200 retreats off the record sheet stacking space in the supplying apparatus unit 5 of the main body of the printer 10, and takes the release position possible of supplying the record sheets 1 stacked on the supply tray 3.

The set arm 106 is formed with one piece of cylindrical boss 106*a* serving as a cam follower and with two pieces of cams 106*b*, 106*c* with the boss 106*a* interposed therebetween (FIG. 12). The boss 106*a*, serving as the cam follower, of the set lever 106 engages with a cam groove 202*d* formed in the upper surface 202. The user rotates the set lever 105 with the result that the boss 106*a* moves while engaging with the cam groove 202*d*, thereby enabling a shift of the position of the photo tray 200.

Further, the two pieces of cams 106*b*, 106*c* respectively control postures of the front cover 103 and of the photo tray 200, corresponding to the rotational positions of the set lever 105.

Incidentally, the set lever spring described above generates frictional force between the photo deck base 101 and the set arm 106 to which the set lever 105 is fastened, thus providing a brake function when the photo tray 200 moves. Namely, the set lever spring is effective in preventing a damage to the leading end of the photographic record sheet 209 set in the photo deck 100 or a damage to the photo tray 200 itself on such an occasion that the photo tray 200 drops by its self-weight down to the standby position just when, for example, the user mistakenly releases the set lever 105 from the user's hand for the duration of a movement of the photo tray 200 from the release position to the standby position, or effective in preventing an emission of impact noises.

An outer peripheral portion of the knob portion of the set lever 105 is formed with a plurality of ribs for preventing a slip when manipulated by the user and one piece of projection 105*a*. The projection 105*a* is structured to indicate the positions 7, 8 as pictorial symbols marked on the photo deck base 101, corresponding to the rotational position of the set lever 105, whereby the user is able to operate the photo deck 100 without any error.

Next, a lock mechanism of the rotational knob, i.e., the set lever 105 will be explained.

Figure 14A:
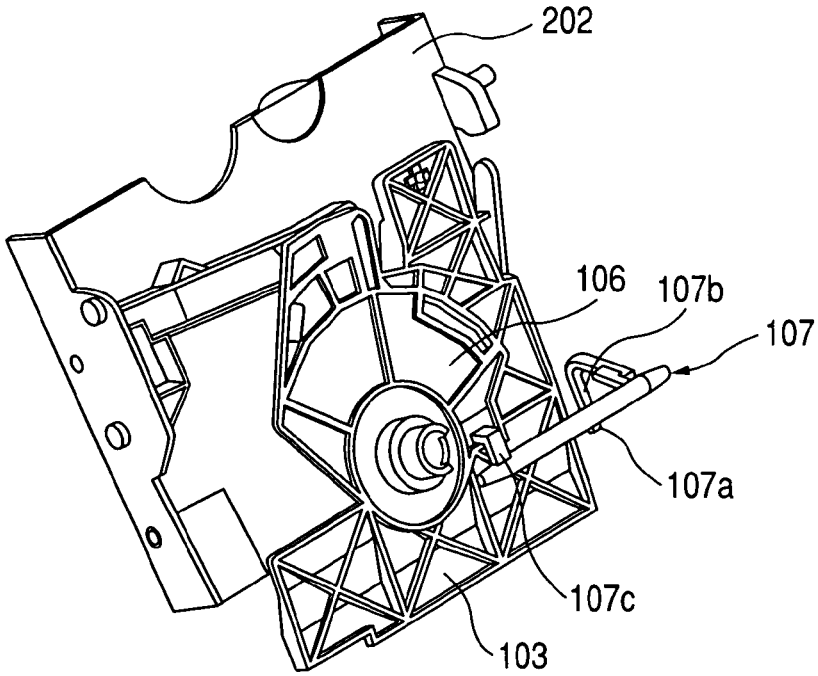
FIGS. 14A and 14B are explanatory views showing a lock mechanism of the manipulation knob in the embodiment of the present invention.
Figure 14B:
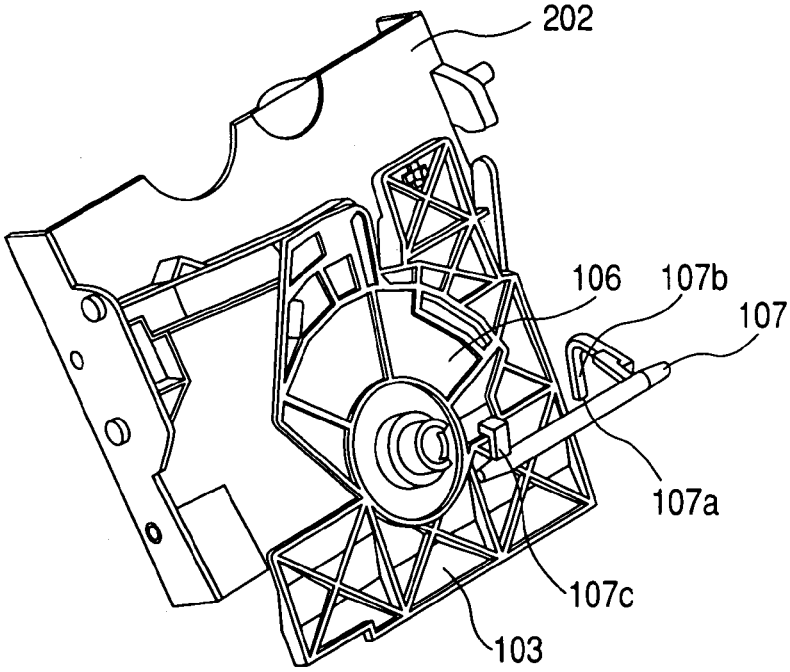

FIG. 14A is an explanatory view showing a locked state of the set lever 105. FIG. 14B is an explanatory view showing an unlocked state of the set lever 105.

The set lever lock mechanism is provided for preventing the photographic record sheets within the photo tray 200 from being exposed to the external light, etc. as the set lever 105 is rotated carelessly when the photo deck 100 is detached from the main body of the printer 10. The set lever lock mechanism has a lock shaft 107 including a shaft body 107*a*, a front end portion 107*b* extending in a right-angled direction from the shaft body 107*a* and abutting on a corresponding member of the main body of the printer 10, and a hook-shaped engagement piece 107*c* engaging with the set arm 106.

Figure 15A:
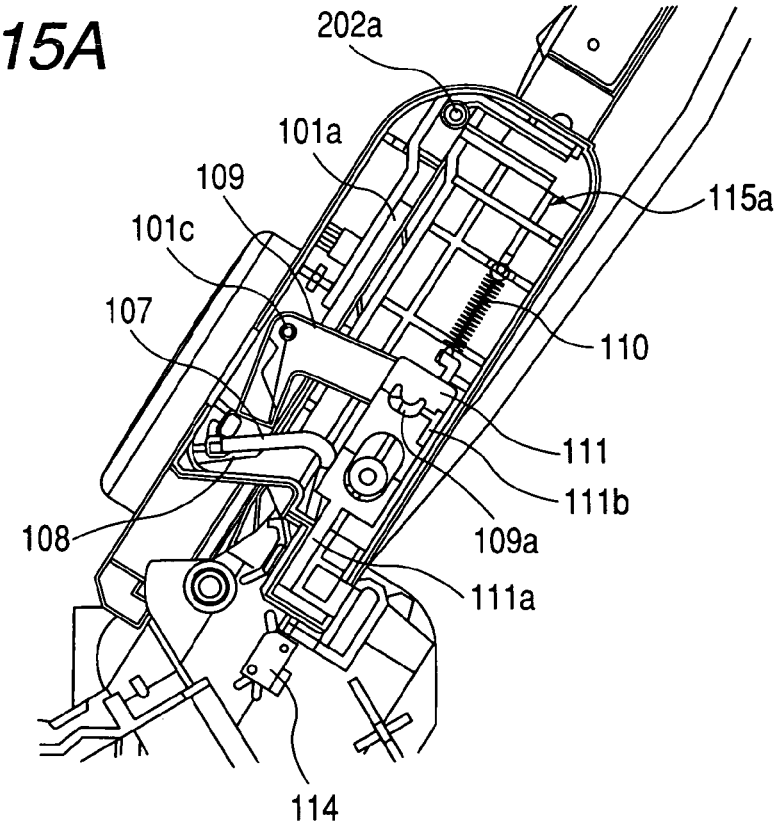
FIGS. 15A and 15B are explanatory views showing a mechanism for detecting a position of the photo tray in the embodiment of the present invention.
Figure 15B:
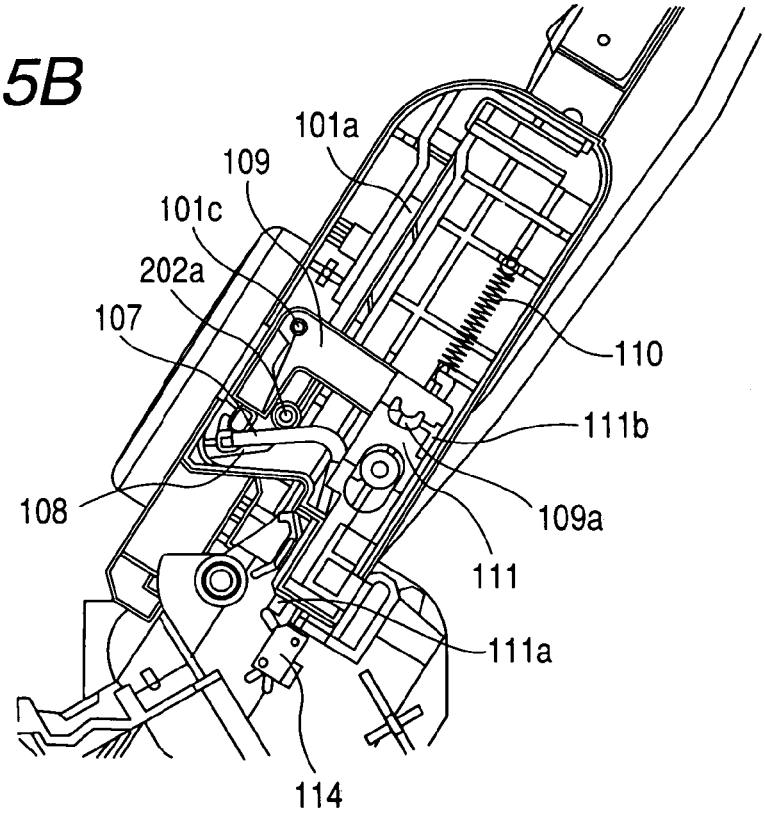

The shaft body 107*a* of the lock shaft 107 is so fitted as to be rotatable about a bearing portion 101*i* of the photo deck base 101 and about a bearing portion (not shown) of the side cover R 115 (see FIGS. 8A and 8B). The lock shaft 107 is, as shown in FIGS. 15A and 15B, biased clockwise by a lock shaft spring 108. When the photo deck 100 is attached to the supplying apparatus unit 5 of the main body of the printer 10, the front end portion 107*b* of the lock shaft 107 is pressed by the member of the supplying apparatus unit 5 with the result that the lock shaft 107 comes to a state being rated counterclockwise (in FIGS. 15A and 15B), whereby the engagement piece 107*c* of the lock shaft 107 comes off the set arm 106 and there occurs the unlocked state of the rotation of the set lever 105. On the other hand, when the photo deck 100 is removed from the supplying apparatus unit 5 of the main body of the printer 10, the front end portion 107*b* of the lock shaft 107 is released, and the lock shaft 107 is rotated clockwise (in FIGS. 15A and 15B) by the biasing force of the lock shaft spring 108, thus shifting to the lockable state. A contrivance in the lockable state is that the engagement piece 107*c* of the lock shaft 107 engages with the set arm 106, thereby locking the rotation of the set lever 105.

Next, a mechanism for detecting a position of the photo tray 200 will be described.

FIG. 15A is an explanatory view showing a case in which the photo tray 200 is in the release position. FIG. 15B is an explanatory view showing a case in which the photo tray 200 is in the standby position.

A position sense lever 109 as a component of the position detecting mechanism for detecting the position of the photo tray 200, is provided within a hollowed portion 115*a* of the side cover R 115. The position sense lever 109 takes substantially an L-shape and is formed with a through-hole at an angular portion of intersection thereof.

The position sense lever 109 is so fitted as to be rotatable through the through-hole to the boss portion lOic formed protruding into the hollowed portion 115*a* from an internal wall configuring the hollowed portion 115*a* of the side cover R 115 and is fitted so that the level 109 is, as shown in FIG. 15A, so biased by a position sense lever spring 110 as to rotate counterclockwise about the boss portion 101*c*. The position sense lever 109 has a structure of being rotated clockwise as shown in FIG. 15B by a boss 202*a* of the photo tray 200 moving along the guide groove 101*a* formed in the internal wall 115*b*.

A position sense link lever 111 as a component of the position detecting mechanism for detecting the position of the photo tray 200 is fitted rotatably slidably in a groove-shaped portion 109*a* of the position sense lever 109. The position sense link lever 111 has a construction capable of converting the rotations of the position sense lever 109 into a parallel motion and turning ON/OFF, with its front end portion 111*a*, a switch of the position sensor 114 provided on the supplying apparatus unit 5 of the main body of the printer 10.

To be specific, as illustrated in FIG. 15A, in the release position, the position sensor 114 is in an OFF-state. When the photo tray 200 moves to the standby position from the release position, as shown in FIG. 15B, the boss 202*a* of the photo tray 200 raises one operation piece of the position sense lever 109 taking substantially the L-shape, and the position sense lever 109 is thereby rotated about the shaft 101*c*, resisting the biasing force of the position sense lever spring 110, and thrusts out the position sense link lever 111 linked to the other operation piece of the lever 109. Thus, the front end portion 111*a* of the lever 111 brings the position sensor 114 into an ON-state.

Given next is an explanation of an attaching lock mechanism of the photo deck 100, for attaching to the recording apparatus body.

Figure 16A:
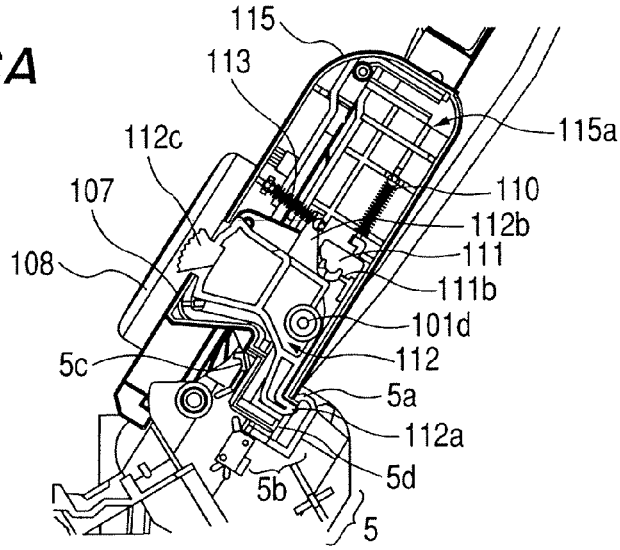
FIGS. 16A, 16B and 16C are explanatory views showing an attaching lock mechanism to the main body of the recording apparatus in the embodiment of the present invention.
Figure 16B:
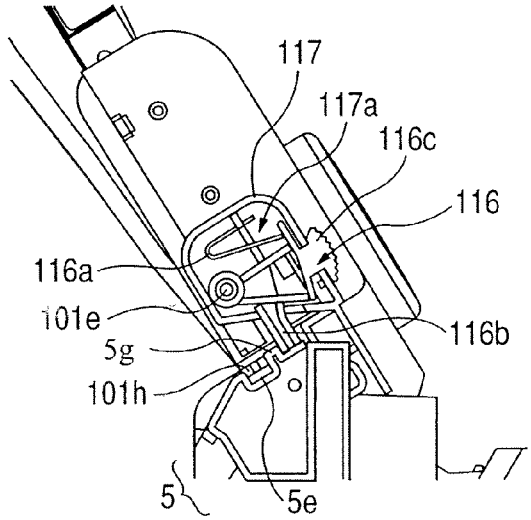
Figure 16C:
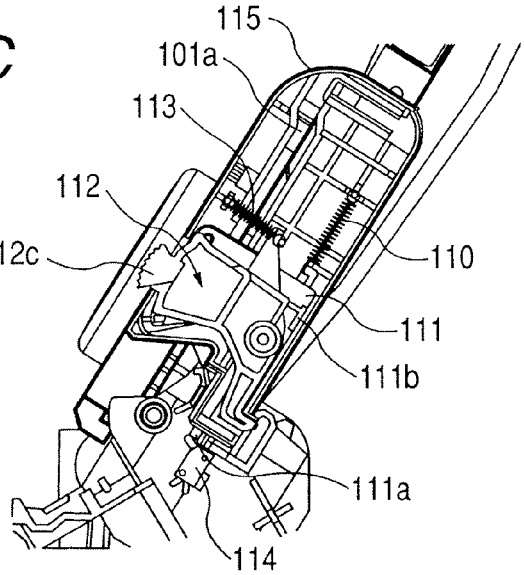

FIG. 16A is an explanatory view showing the lock mechanism of the photo deck 100 on the right side (the fiducial side) as viewed from the front of the apparatus. FIG. 16B is an explanatory view showing the lock mechanism on the left side (the non-fiducial side). FIG. 16C is an explanatory view showing the photo deck fiducial side lock mechanism when in the standby position. FIGS. 16A through 16C respectively show a state where the external walls of the side covers R, L are removed.

Referring to FIG. 16A, the lock lever R 112 is rotatably fitted to the boss 101*d* provided within the hollowed chamber 115*a* as the hollowed portion of the side cover R 115 so that a front end pawl-shaped portion 112 thereof protrudes outside from an external configuration of the side cover R 115 of the photo deck base 101. Further, the lock lever R 112 is so biased as to rotate counterclockwise about the boss 101*d* in FIG. 16A by a spring 113 for the lock lever R that is secured to the photo deck base 101 through a support piece 112*b* of the lock lever R 112.

The front end pawl-shaped portion 112*a* of the lock lever R 112 engages with an engagement recessed portion 5*a* formed in a photo deck fitting portion (plate portion) 5*b* of the supplying apparatus unit 5 of the main body of the printer 10, whereby the photo deck base 101 is attached to the main body of the printer 10. Note that the removal of the photo deck 100 out of the main body of the printer 10 may involve rotating the lock lever R 112 clockwise resisting the spring 113 by the other end of the lock lever R 112 through a knob 112*c* formed protruding outside the side cover R 115 and releasing the front end pawl-shaped portion 112*a* from the receiving portion 5*a*.

Referring to FIG. 16B, the lock lever L 116 is rotatably fitted to the boss 101*e* provided within a hollowed chamber 117*a* of the side cover L 117. The lock lever L 116 is formed with a thin plate-shaped portion 116*a* and is biased clockwise about the boss 101*e* in FIG. 16B by utilizing elastic deformation of the thin plate-shaped portion 116*a* thereof. The lock lever L 116 is attached in such a way that a protruded engagement portion 116*b* of the lever L 116 engages with the plate portion 5*b* formed in the supplying apparatus unit 5 of the main body of the printer 10. Note that the removal of the photo deck 100 from the main body of the printer 10 may involve rotating the lock lever L 116 counterclockwise resisting the elastic force of the thin plate-shaped portion 116*a* through the knob 116*c*, formed protruding outside the side cover L 117, of the lock lever L 116, and releasing the protruded engagement portion 116*b* from the plate portion 5*b*.

The side cover R 115 (see FIG. 8A) is snap-fitted to the photo deck base 101, and covers a space 115*a* accommodating the mechanism parts such as the position sense lever 109, the position sense link lever 111, the lock lever R 112, etc. The side cover R 115 is provided with a plurality of projections serving as a slip resistive portion that prevents a slip of the user's fingers when the user attaches and detaches the photo deck 100 to and from the main body of the printer 10.

The side cover L 117 (see FIG. 8B) is snap-fitted to the arm portion 107*a* and covers a space 117*a* accommodating the lock lever L 116. The side cover L 117 is, as in the case of the side cover R 115, provided with a plurality of projections serving as a slip resistive portion that prevents the slip of the user's fingers when the user attaches and detaches the photo deck 100 to and from the body of the recording apparatus.

As shown in FIG. 16C, when the photo tray 200 moves from the release position to the standby position in a state where the photo deck 100 is attached to the supplying apparatus unit 5 of the recording apparatus body, as described above, the position link lever 111 is extruded, and the front end 111*a* of this lever 111 sets the position sensor 114 in the ON-state. At this time, a T-shaped portion 111*b* provided on the position sense link lever 111 enters a rotational range of the lock lever R 112, thereby regulating the rotation of the lock lever R 112. Hence, when the photo tray 200 is kept in the standby position, the lock lever R 112 is unable to be manipulated, and it is therefore impossible to detach the photo deck 100 from the recording apparatus body.

For instance, if the photo deck 100 is detached from the main body of the printer 10 in the standby position, the posture of the photo tray 200 can not be settled, and hence the photo tray 200 further largely extends from the photo deck base 101. This induces a great possibility in which the photographic record sheets 209 and the photo tray 200 might be damaged due to carelessness, etc. when the user handles them. The present lock mechanism is, however, greatly helpful for avoiding the above possibility.

As explained above, the lock mechanism of the lock lever R 112 must be released by rotating the set lever 105 to the position 7 in order to detach the photo deck 100 from the recording apparatus body. As previously described, in the state where the set lever 105 is in the position 7 and the photo deck 100 is detached from the recording apparatus body, the lock shaft 107 is in a state of locking the rotation of the set lever 105. Hence, in the state where the photo deck 100 is detached from the recording apparatus body, the set lever 105 is in the locked state. It is therefore feasible to prevent the damages to photographic record sheets 209 accommodated in the interior of the photo tray and to the body of the photo tray 200, which might be caused when the user carelessly gets the photo tray 200 out to the standby position by manipulating the set lever 105.

Next, the discussion will get back to a method of using the photo deck 100.

FIG. 1 shows a state in which the photo deck 100 is attached to the recording apparatus body and is in the release position. FIG. 2 shows a state in which the photo deck 100 is detached from the recording apparatus body. FIG. 3 is an explanatory view showing a state in which the photo deck 100 is attached to the recording apparatus body and is in the standby position.

The user attaches the photo deck 100 to the supplying apparatus unit 5 of the recording apparatus body in a way that moves the photo deck 100 substantially in parallel with a pressure plate 51 (see FIGS. 20 and 21) of the supplying apparatus unit 5 of the main body of the printer 10 from the state shown in FIG. 2, wherein the photo deck 100 is detached. As a result of this, there comes to the state in FIG. 1.

The leg portion lOif (see FIGS. 8A and 8B) formed on the side cover R 115 on the right side (as viewed from the front of the main body of the printer 10) of the photo deck 100, is inserted up to the photo deck fitting portion (the plate portion) 5*b* (see FIG. 16A) of the supplying apparatus unit 5 by penetrating an exterior fitting hole 2*a* of the main body of the printer 10. At this time, a protruded portion (unillustrated) formed in the vicinity of the fitting hole 2*a* (see FIG. 2) of the supplying apparatus unit 5 abuts on a grooved portion (not shown) formed in the ceiling portion of the leg portion lOif of the photo deck 100, thereby determining a position in the inserting direction. Further, a backlash restraining structure is that the leg portion 101*f* of the photo deck 100 is fitted in between the rib-shaped portions 5*c* and 5*d* (see FIG. 16A) formed up and down on the supplying apparatus unit 5, thereby restraining the backlash of the rotation of the photo deck 100 about the leg portion 101*f* as the rotational center. Moreover, according to the present embodiment, the side wall of the supplying apparatus unit 5 is pinched from right and left by the leg portion 101*f* and the rib-shaped portion 101*g* (see FIG. 8B) biased by plate thickness of the side wall of the supplying apparatus unit 5 from the leg portion 101*f*, which portions 101*f*, 101*g* are formed on the side cover R 115 of the photo deck 100, thereby positioning the photo deck 100 in the widthwise direction (the record sheet widthwise direction).

A positioning structure on the left side (as viewed from the front of the main body of the printer 10) of the photo deck 100, is that a photo deck positioning rib 101*h* formed on the side cover L 117 is fitted in a fitting groove 5*e* of the attaching portion 5*b* provided at an upper part of the supplying apparatus unit 5 (see FIG. 16B).

At this time, the lock lever R 112 engages with the receiving portion 5*a* formed in the attaching portion 5*b* of the supplying apparatus unit 5, thereby locking the photo deck 100 so as not to come off in the direction opposite to the attaching direction. The lock lever L 116, as in the case of the lock lever R 112, pinches the attaching portion 5*g* of the supplying apparatus unit 5 in cooperation with the rib 101*h*, thereby locking the photo deck so as not to come off in the direction opposite to the attaching direction.

Further, the photo deck 100 is attached to the supplying apparatus unit 5, whereby the front end portion 107*a* (see. FIG. 4A) of the lock shaft 107 that protrudes between the leg portion 101*f* (see FIG. 8A, 8B) and the rib-shaped portion 101*g* is intruded by the side wall of the supplying apparatus unit 5. The lock shaft 107 is thereby rotated counterclockwise and unlocked from the set arm 106 (see FIG. 14A).

Subsequently, the photographic record sheets 209 are set in the photo tray 200.

Figure 17:
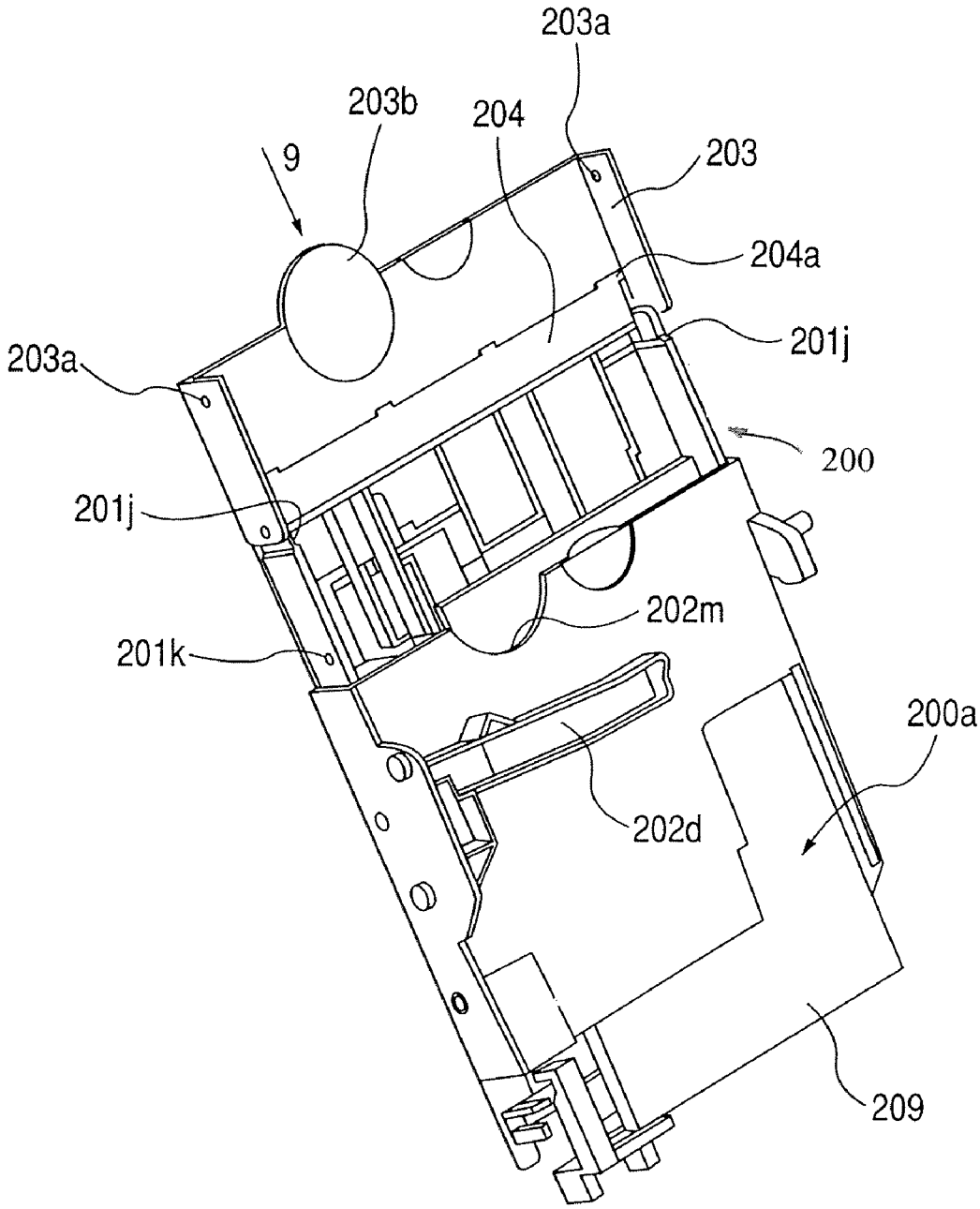
FIG. 17 is an explanatory view showing how a photographic recording sheet is set in only the photo tray in the embodiment of the present invention.

FIG. 17 is an explanatory view illustrating only the photo tray 200 and showing how the photographic record sheets 209 are set in the photo tray 200.

In the state where the photo tray 200 is in the release position, the user puts the fingers on a semi-spherically protruded portion 203*b* of the cover 203 and thus opens the cover 203. A construction of the top cover 204 is that simultaneously when opening the cover 203, there opens the top cover 204 so fitted as to be rotatable about a hole 201*c* (see FIG. 10) of the lower case and biased by a top cover spring 205 so that its end portion opposite to the rotational center abuts on the cover 203. With this construction, when opening the cover 203, a set port for the photographic record sheets 209 largely opens, thereby facilitating the setting of the photographic record sheets 209.

The photographic record sheets 209(the L-sized photographic glossy paper) are set in the photo tray 200 in a direction indicated by an arrowhead 9 in FIG. 17. A semi-circularly notched portion 202*m* formed in the upper case 202 (see FIG. 9B) facilitates the setting of the photographic record sheets because of being capable of setting even the small-sized photographic record sheets as in the case of the L-size in this embodiment in an as-pinched-by-fingers state till a completion of the setting. Further, this notched portion 202*m* (see FIG. 17) has an effect in facilitating the pinching also when taking the photographic record sheets from the photo tray 200.

Figure 18:
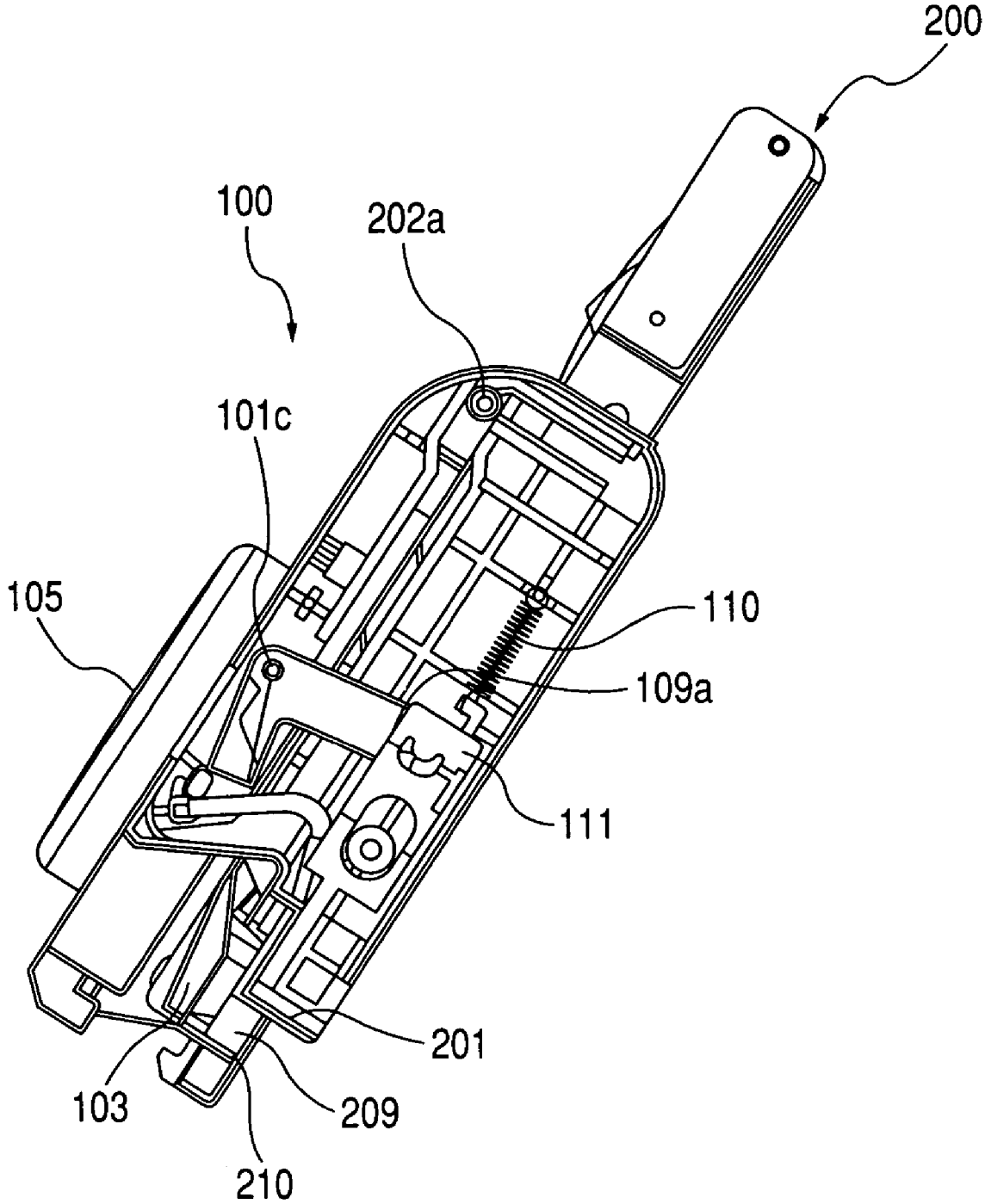
FIG. 18 is an explanatory view showing a side surface of the photo deck in the release position in the embodiment of the present invention.

As illustrated in FIG. 18, the front cover 103 is constructed to cover, in the release position, the L-shaped aperture portion (notched portion) 200*a* (see FIG. 11) for the sheet type discriminating sensor 4 (see FIG. 5) of the upper case 202. In this state, as illustrated in FIG. 18, the downstream side of the front cover 103 in the conveying direction protrudes smoothly in its surface towards the lower case 201, and is employed as a first regulating means of the sheets 209 by restraining the upper side, in the thicknesswise direction, of the front end of the photographic record sheets 209 to be set within a thicknesswise dimension (height) of the sheet receiving surface (sheet front end abutting portion) 210*a* of the lever 210.

On the other hand, a lower side, in the thicknesswise direction, of the front end of the photographic record sheets 209 is regulated by the record sheet stacking surface, as a second regulating means, of the lower case. Incidentally, it is contrived that a position of the lower side position of the lever 210 in the record sheet thicknesswise direction is set under the record sheet stacking surface of the lower case 201 in the thicknesswise direction. Moreover, a protruded portion 201*l* (see FIG. 9B) as a guide means for guiding the record sheets 209 is so provided in the vicinity of the lever 210 of the lower case 201 as to be overlapped with upper and lower protruded portions 210*b*, 210*c* (see FIG. 11) as guide means for guiding the sheet end portion, which are formed on the sheet receiving surface 210*a* of the lever 210 in the record sheet conveying direction. As described above, the record sheet front end can be prevented from coming off the lever 210 when setting the photographic record sheets 209 by establishing the positional relationship between the lower case 201, the lever 210 and the front cover 103. It is therefore possible to simply set the sheets 209 without any failure when setting them. There is a large effect particularly when setting the curled photographic record sheets.

The user inserts the photographic record sheets 209 into the photo tray 200 till the front ends of the record sheets are brought into contact with the record sheet stacking surface (the receiving surface) 210*a* of the lever 210. Then, the user closes the cover 203.

Reversely when opening the cover 203, as the cover 203 is closed, the top cover 204 as a sub cover member simultaneously closes while one end thereof slides on the cover 203. A contrivance in the closed state of the cover 203 is that the top cover 204 is regulated in its rotation in an externally opening direction by the cover 203 and can, when rotating in an inward fall-down direction, rotate neither in an internal direction or in an external direction as a portion 204*a* of the top cover 204 is regulated by a stepped portion 201*j* of the lower case 201 (see FIG. 17). This contrivance makes it possible to prevent the come-off of the photographic record sheets 209 through an aperture formed when the top cover 204 falls inwards in the closed state of the cover 203 and to prevent troubles such as damages to the surface of the photographic record sheet due to the insertion of the photographic record sheet 209 from the aperture, and so forth.

When closing the cover 203, a feeling of click occurs just when a hole portion 203*a* formed in the side wall of the cover 203 engages with a protruded portion 201*k* formed on the lower case 201, whereby a preferable feeling of operation can be acquired.

After attaching the photo deck 100 to the supplying apparatus unit 5 of the main body of the printer 10, the photo tray 200 is moved to the standby position from the release position. In this case, the user rotates the set lever 105 counterclockwise by pinching a portion vicinal to the rib of the set lever 105. At this time, the set lever 105 and the set arm 106 are integrally formed and therefore rotate together.

Upon a rotation of the set arm 106, the cam 106*b* (FIG. 12) formed on the set arm 106 gets separated from the cam follower of the front cover 103. When separated, the front cover 103 is rotated by the biasing force of the front cover spring 104 (see FIG. 9A) till the downstream side of the front cover 103 in the conveying direction abuts on the photo deck base 101, and therefore retreats upwards from a moving region of the photo tray 200. Namely, the front cover 103 is spaced away from the photo tray 200 when in the standby position.

The boss 106*a* (FIG. 12) as the cam follower moves while engaging with the cam groove 202*d* (see FIG. 9A) of the upper case 202, whereby the rotational motion of the set arm 106 is converted into the vertical movement in the conveying direction of the photo tray 200.

With the rotation of the set arm 106, totally three pieces of bosses, i.e., one pair of bosses 202*a* and one boss 202*b* which are provided on the two side plates of the photo tray 200 are fitted in the guide groove 101*a* (see FIG. 8B) formed in the internal side wall 115*a* of the side cover R 115 and the guide grooves 102*a*, 102*b* (see FIG. 8A) formed in the internal side wall of the left side wall 102 provided integrally with the photo deck base 101, and hence the photo tray 200 moves in a state of regulating the rotation of the photo tray 200 about the bosses 202*a*.

As the boss 106*a* of the set arm 106 is in a right position slightly exceeding an upper dead point of the rotation in the release position, the photo tray 200, after moving at first a bit upstream, then moves downstream.

Further, the photo tray 200 is structured to move downstream in the conveying direction and also simultaneously moves downwards (in a direction orthogonal to the conveying direction) in the stacking direction along the grooved portions of the side cover R 115 and of the left side wall 102. With this structure, the photo tray 200 can be positioned closer to the pressure plate 51 (see FIG. 20) of the supplying apparatus unit 5 in the standby position and positioned sway from the pressure plate 51 in the release position. The photo tray 200 is in the position separated from the pressure plate 51 in the release position, thereby improving the setting characteristic of the record sheets 1 into the supplying apparatus unit 5 of the main body of the printer 10. Further, the photo tray 200 is in the position vicinal to the pressure plate 51 in the standby position, whereby separation performance can be ensured.

As shown in FIG. 12, the photo tray 200 is moved halfway by the movement of the boss 106*a* fitting in the cam groove 202*d* but is moved to the standby position from a middle phase by the protruded portion 106*d* of the set arm 106 in such a way that this protruded portion 106*d* engages with a cam portion 202*e* of the upper case 202. The photo tray 200 can be surely moved to the standby position by taking a structure of pushing up the photo tray 200 with the cam even in a case where the photo tray 200 has a load on its movement and is hard to move by its self-weight.

The cam portion 202*e* of the upper case 202 that serves as the abutting portion on the set arm 106 is provided on the line (that connects the pair of bosses 202*a*) substantially concentric with the rotational center of the photo tray 200. A contrivance of providing the cam portion 202*e* on the line substantially concentric with the rotational center, has an effect of hindering, as will be mentioned later on, an increase in the rotational load when the photo tray 200 rotates after the photo tray 200 has moved to the standby position. If the rotational load rises, there decreases the force by which the pressure plate 51 of the supplying apparatus unit 5 presses the photo tray 200 against the supply roller 52, resulting in causing deterioration in supplying the record sheets. As described above, this deterioration can be prevented by disposing the cam portion 202*e*.

Further, the front end portion of the lever 210 is provided with two pieces of protruded portions 210*d*, 210*e* of which angular portions and ridged portions are rounded and surfaces are smoothed (see FIGS. 4 and 5). This is a scheme for preventing the damage from being exerted on the record sheets 1 in such a manner that if the leading ends of the record sheets 1 stacked on the supply tray 3 of the main body of the printer 10 protrude on the side of the sheet feeding roller 52 and enter the moving region of the photo tray 200, when moving the photo tray 200 to the standby position from the release position, at first the protruded portions 210*d*, 210*e* having the smooth surfaces come into contact with the record sheets 1 and push the record sheets 1 back towards the pressure plate 51 as the photo tray 200 moves.

Figure 19:
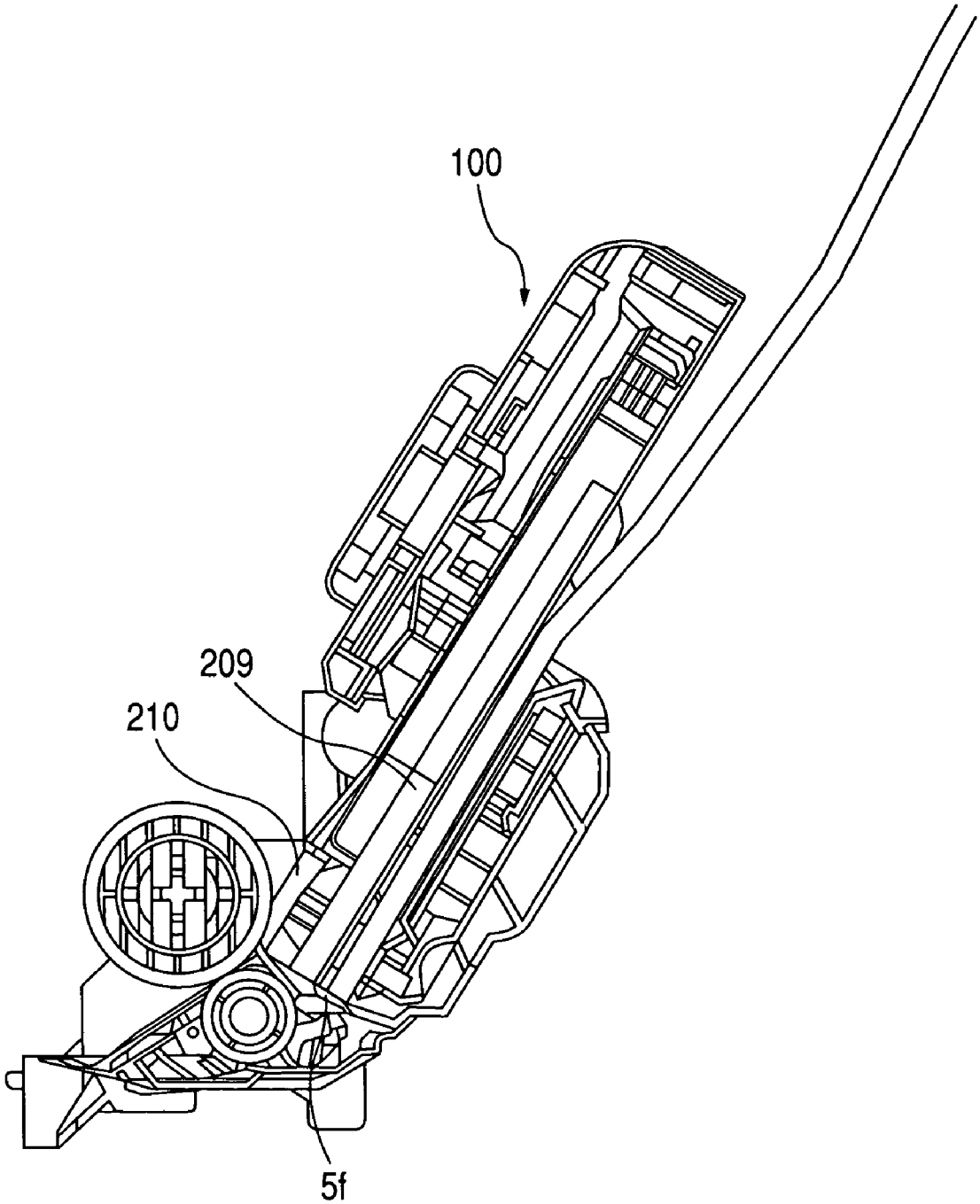
FIG. 19 is an explanatory sectional view of the photo deck and the supplying apparatus unit of the main body of the recording apparatus in the standby position in the embodiment of the present invention.

As illustrated in FIG. 19, in the standby position, the lever 210 on which the leading ends of the photographic record sheets 209 stacked in the photo deck 100 abut, sinks deeper than the record sheet stacking portion 5*f* of the supplying apparatus unit 5 of the recording apparatus body, and hence the photographic record sheets 209 stacked on the photo tray 200 are, as in the case of the record sheets 1 stacked in the supplying apparatus unit of the recording apparatus body, to be stacked on the record sheet stacking portion 5*f* of the supplying apparatus unit 5 of the recording apparatus body.

Moreover, in the standby position, the boss 106*a* defined as the cam follower of the set arm 106 is structured to be in a position well spaced away from the cam groove 202*d* of the upper case 202. This aims at preventing, on the occasion that the photo tray 200 rotates about the boss 202*a* as the rotational center when supplying the sheets from the photo deck 100, the boss 106*a* of the set arm 106 and the cam groove 202*d* of the upper case 202 from interfering with each other.

Next, the sheet supply from the photo deck 100 will be explained.

Figure 20:
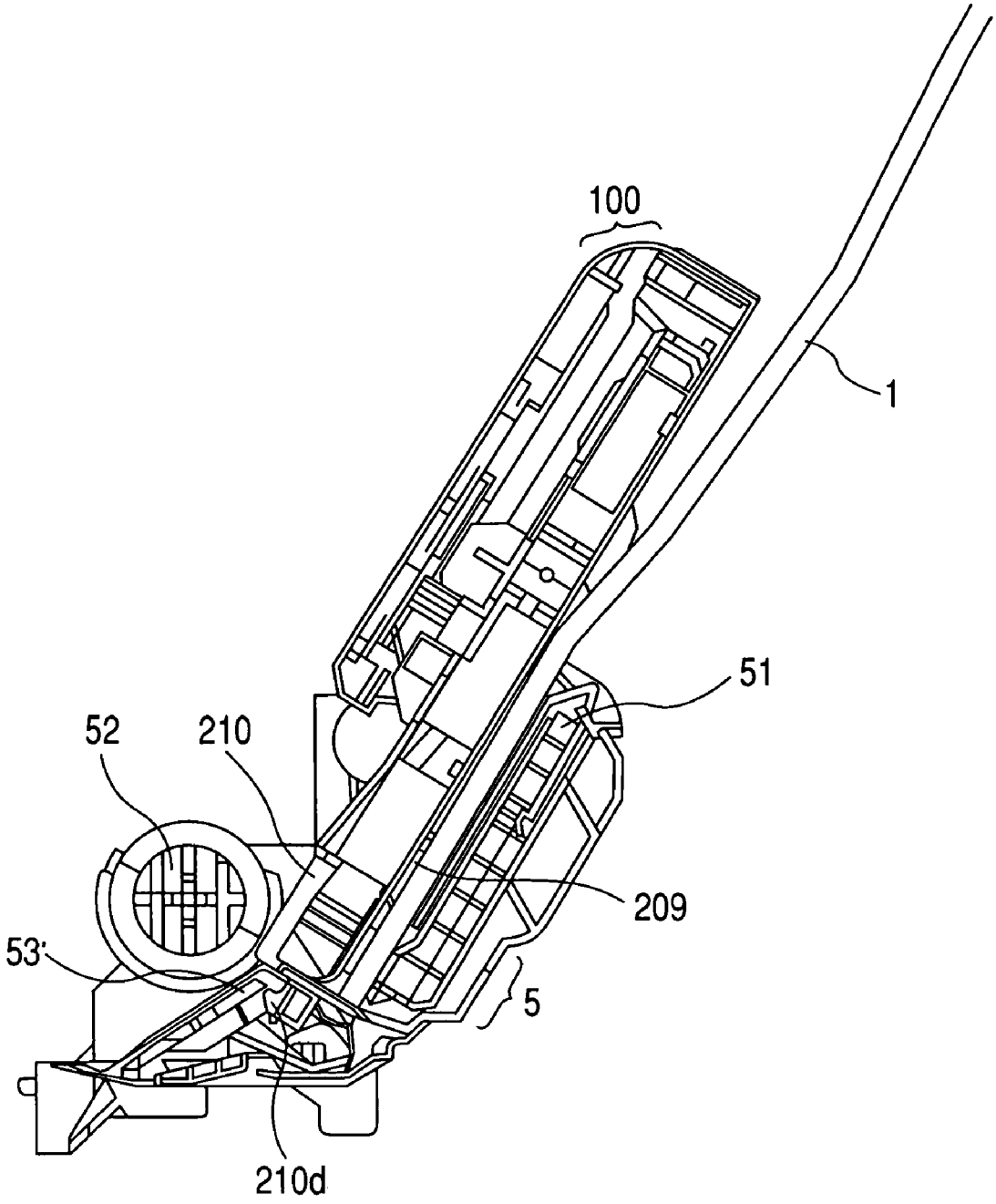
FIG. 20 is an explanatory sectional view showing a state of being in the standby position where one photographic recording sheet is set in the photo tray in the embodiment of the present invention.
Figure 21:
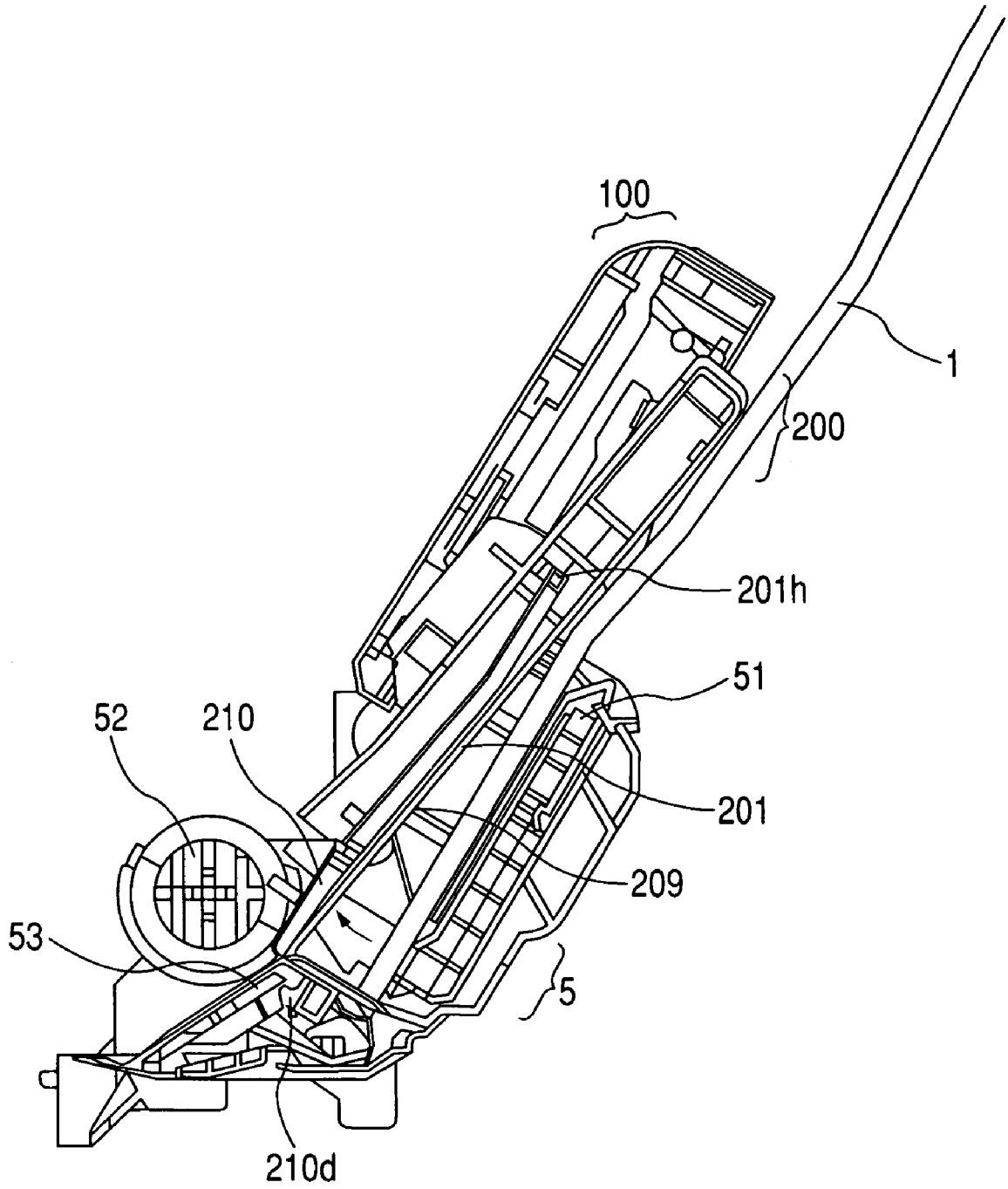
FIG. 21 is an explanatory sectional view showing how the sheet is supplied from the photo deck in the embodiment of the present invention.

FIG. 20 is an explanatory sectional view showing a state of being in the standby position where one photographic record sheet 209 is set in the photo tray 200. FIG. 21 is an explanatory sectional view showing how the sheet is supplied from the photo deck 100.

As illustrated in FIG. 20, when a sheet supply instruction based on a print start command is given from a host computer in the state where the photo deck 100 is in the standby position, an unillustrated ASF (Auto Sheet Feeder) motor is driven, a pressure plate cam (not shown) is rotated through a gear train (unillustrated), and the pressure plate 51 is rotated clockwise about a rotary shaft (unillustrated). As shown in FIG. 21, the pressure plate 51 pushes up the lower case 201 of the photo tray 200 together with the stacked record sheets 1, and therefore the photo tray 200 is rotated clockwise about the boss 202*a* (FIG. 9A) as the pressure plate 51 is rotated. Then, the uppermost surface of the photographic record sheets 209 stacked on the photo tray 200 abuts on the supply roller 52 of the supplying apparatus unit 5. At this time, a hook-shaped portion 210*d* provided at the front end portion of the lever 210 is regulated in its movement by the protruded portion 53 of the supplying apparatus unit 5 of the recording apparatus body, and is therefore rotated counterclockwise about the rotary shaft (hole) 201*h* of the lower case 201 relatively to the photo tray 200, whereby there opens a sheet path (the supply route for supplying the photographic record sheets 209 from the photo tray 200. From this state, the photographic record sheets 209 stacked on the photo tray 200 are separated and thus supplied sheet by sheet in a way that the sheet supply mechanism and the sheet separating mechanism of the supplying apparatus unit 5 of the recording apparatus body are employed in combination. The residual photographic record sheets 209 are pulled through the pressure plate 51 of the ASF back to the initial position in the photo tray 200 by a return pawl of the supplying apparatus unit 5 with the record sheet 1 stacked on the pressure plate 51. The thus-adopted configuration does not require the drive mechanism for the photo deck itself and can be therefore simplified and can decrease the cost.

Next, the movement of the photo tray 200 from the standby position to the release position will be explained.

In the standby position, as described in FIG. 12, when the set lever 105 is rotated clockwise, the set arm 106 provided integrally with the lever 105 is rotated together. For a period till the boss 106*a* as the cam follower of the set arm 106 abuts on the cam groove 202*d* of the upper case 202, the cam 106*c* formed on the set arm 106 abuts on the cam follower 202*f* of the upper case 202, and the photo tray 200 is rotated about the rotary shaft (corresponding to the axial line that connects the pair of bosses 202*a*) so that at first the posture of the photo tray 200 becomes substantially parallel with the guide grooves 101*a*, 102*a*, 102*b* formed in the side cover R 115 and in the left side wall 102. A relative position of the lever 210 to the photo tray 200 is thereby ensured in a normal position, and hence it is possible to prevent such inconvenience that the edge portion of the lever 210 catches and raises the record sheet 1 stacked on the pressure plate 51 of the supplying apparatus unit 5 when moving the photo tray 200 to the release position without any protrusion of the edge portion of the lever 210 towards the underside of the photo tray 200.

Next, the boss 106*a* as the cam follower abuts on the cam groove 202*d* of the upper case 202, thereby moving the photo tray 200 upstream in the record sheet supplying direction along the guide grooves 101*a*, 102*a*, 102*b* formed in the side cover R 115 and in the left side wall 102. The photo tray 200 is constructed to move also upwards in the record sheet stacking thicknesswise direction from the middle phase along the shapes of the guide grooves. This makes, though described above, it possible to preferably ensure the operability when setting the record sheet 1 in the supplying apparatus unit 5 of the main body of the printer 10.

Given next is an explanation of a case of utilizing a medium for a panorama photograph size.

Figure 22:
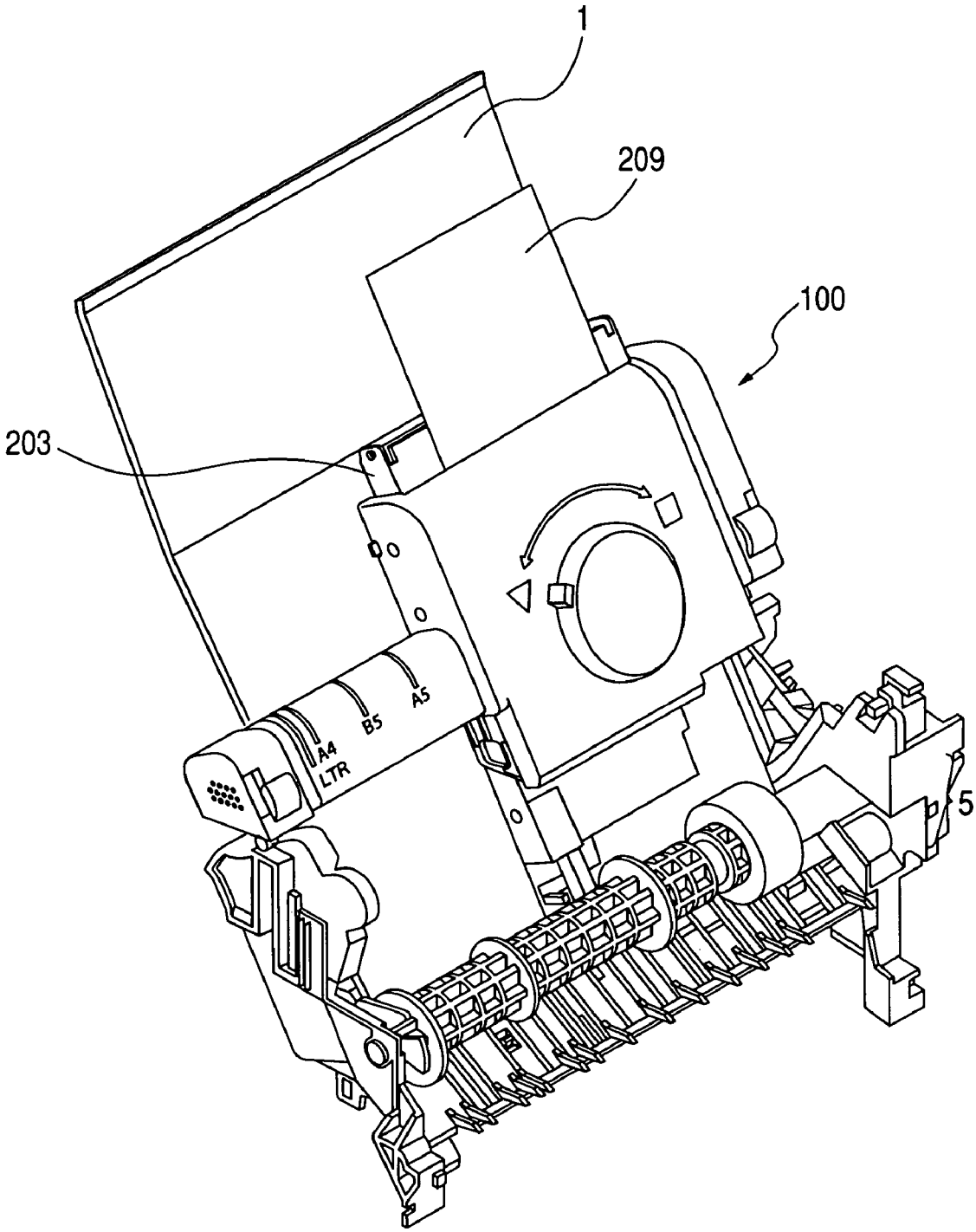
FIG. 22 is an explanatory view when using the photographic recording sheet of a panorama photographic size in the embodiment of the present invention.

FIG. 22 is an explanatory view when using the photographic record sheet 209 having the panorama photograph size.

It is the same as the above-mentioned to set the photographic record sheet 209 having the panorama photograph size into the photo tray 200 by opening the cover 203 in the release position. When setting the photographic record sheet 209 having the panorama photograph size, the record sheet 209 largely protrudes from the photo tray 200 towards the upstream side in the supplying direction and is therefore used with the shift to the standby position while the cover 203 remains opened. With this contrivance, it is feasible to correspond to the photographic record sheet having the panorama photograph size without upsizing the photo deck body more than required. Similarly, the apparatus can be utilized for narrow and elongate envelopes, etc. Hence, it is possible to attain the apparatus prevented from being upsized, constructed to decrease the cost and exhibiting a preferable style.

According to the embodiment described above, the discussion has proceeded so far on the assumption that the record sheet on the photo tray 200 is referred to as the photographic record sheet for the convenience's sake, however, the sheet stacked herein is not limited to the photographic record sheet, and the present invention can be, as a matter of course, applied to the whole categories of record sheets.

Figure 23:
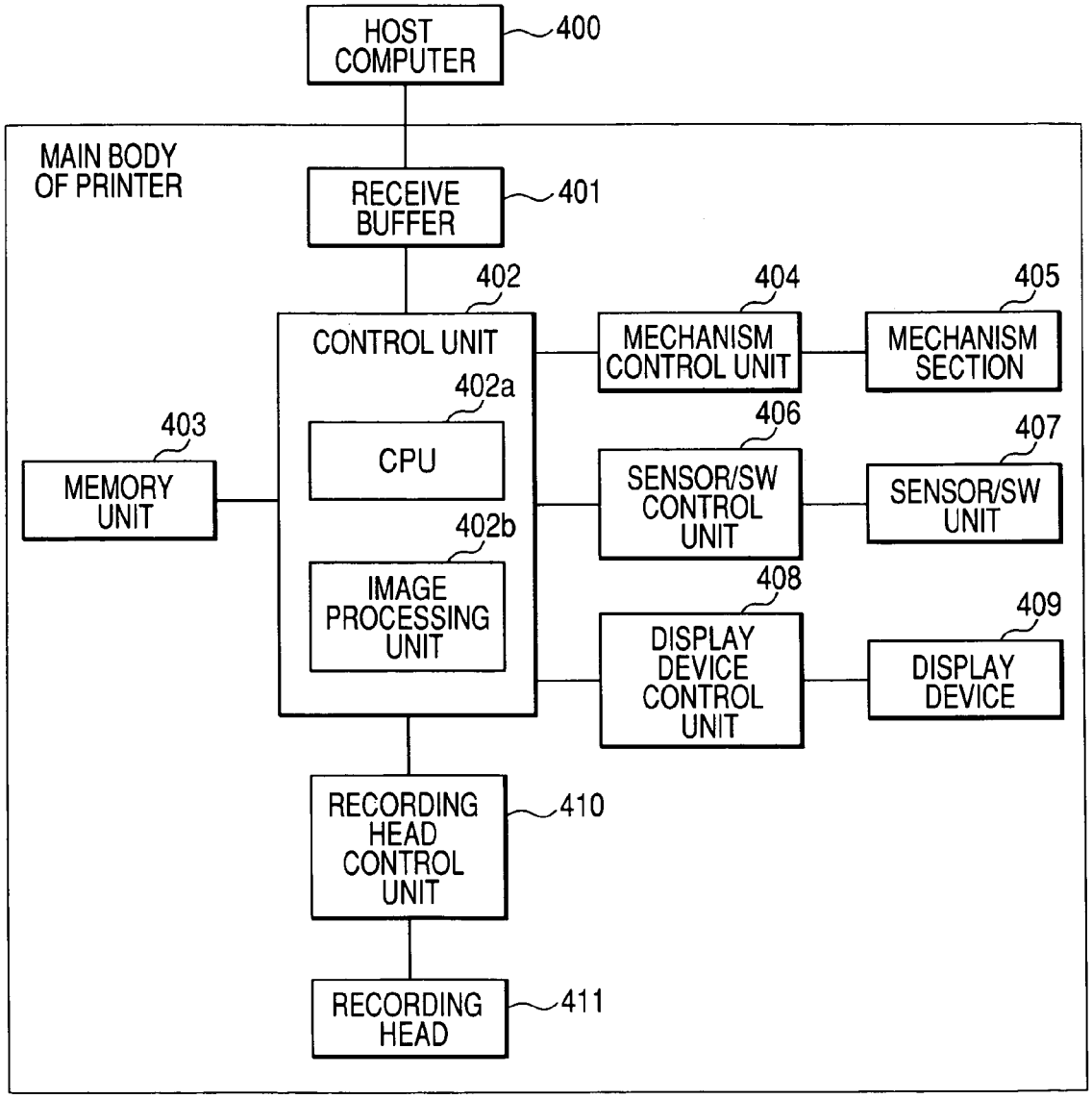
FIG. 23 is a block diagram showing a control construction of an inkjet printer in the embodiment of the present invention.

Next, an architecture of a control system of the present inkjet printer will be explained with reference to a block diagram in FIG. 23.

The inkjet printer 10 can be employed by establishing a connection to a host computer 400. The inkjet printer 10 is capable of receiving instruction signals for printing, etc. and character data and image data (which will hereinafter be generically referred to as the image data) that should be recorded, and recording an image corresponding to the image data. Further, the inkjet printer 10 sends back to the host computer 400 a piece of data for checking whether or not the data are properly transferred to the inkjet printer 10 from the host computer 400 and a piece of data for notifying the host computer 400 of an operation state of the inkjet printer 10.

The record data received from the host computer 400 are inputted to a receive buffer 401 of the inkjet printer 10. The inkjet printer 10 includes a control unit 402 having a CPU 402*a* for governing and controlling the recording operation on the basis of the data inputted to the receive buffer 401. The control unit 402 includes an image processing unit 402*b* for executing processing of the image data inputted to the receive buffer 401, decompressing the compressed image data and generating the data for recording by detecting a color-to-color boundary and a blank. Connected to the control unit 402 are a memory unit 403 constructed of a RAM (Random Access Memory) for caching (temporarily storing) the received image data, etc. and control units of the respective portions.

Next, the respective control units will be described. A mechanism control unit 404 controls driving of a mechanism section 405 of a carrier motor, an LF motor, etc. A sensor/SW control unit 406 processes signals from a sensor/SW unit 407 including a variety of sensors such as the sheet type discriminating sensor 4, the tray position detecting sensor (the position sensor) 114, etc. and the SW (switch). A display device control unit 408 controls a display device unit 409 including an LED of a display panel group, a liquid crystal display device, etc. A recording head control unit 410 controls a recording head 411. These control units operate based on instructions from the control unit 402 and transmit feedback signals, etc. to the control unit 402 as the necessity may arise. For example, the recording head control unit 410 sends temperature information indicating a state of the recording head 411 to the control unit 402.

Figure 24:
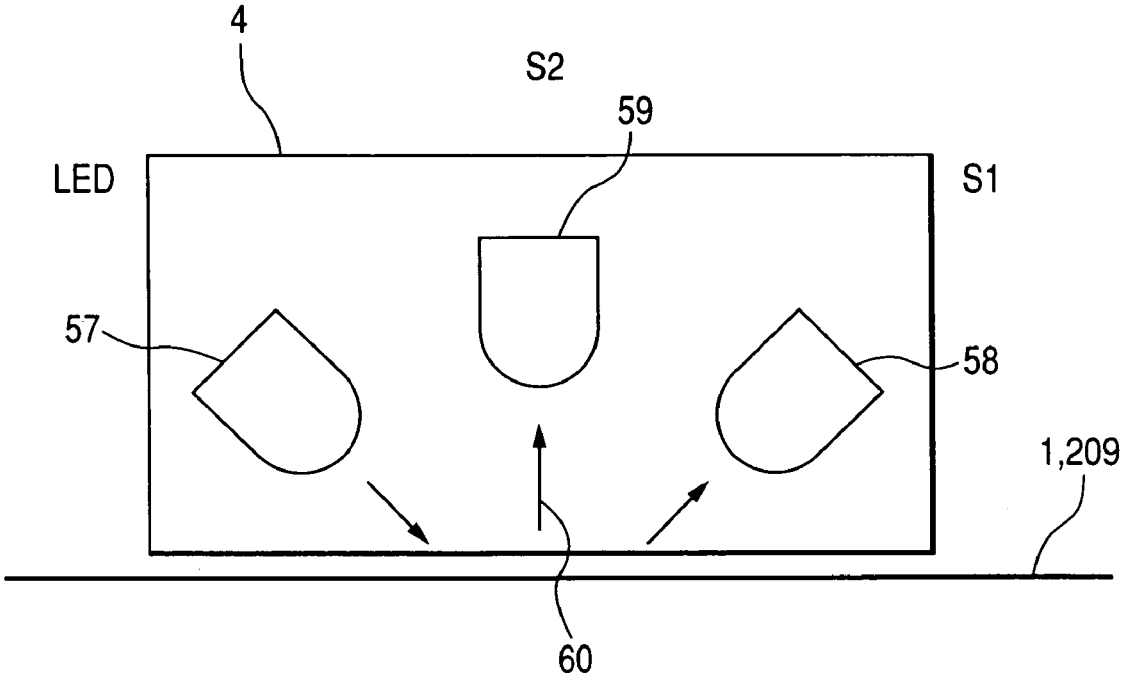
FIG. 24 is a view showing a construction of the recording sheet type discriminating sensor in the embodiment of the present invention.

Next, a construction of the sheet type discriminating sensor 4 will be described referring to FIG. 24.

The light is projected obliquely on the surface of the record sheet 1 or 209 from a light emitting diode (LED) 57 and travels as indicated by an arrowhead 60. Two pieces of light receiving devices (S1) 58 and (S2) 59 receive the reflected light, and the record sheet type is judged from respective amounts of light beams.

The record sheets are classified into a glossy tone, a semi-glossy tone, a matte tone, plain paper, coat paper, a postcard, an inkjet postcard and an OHP film. The light receiving amount changes corresponding to these sheet types. The sheet type discriminating sensor 4 is the sensor utilizing this characteristic. As a matter of course, the detecting means is not limited to this system, and other methods may also be taken.

Further, the sheet supplying apparatus and the recording apparatus according to the present invention, are not limited to the inkjet printer described above and can be applied to whatever apparatuses constructed to supply the sheet and perform desired processing on the sheet.

According to each of the embodiments of the present invention, it is possible to provide the sheet supplying apparatus and the recording apparatus including this supplying apparatus, wherein generally one sheet stacking space can be stacked with both of the plain paper and the photographic record sheets, the switchover as to which type of sheet is supplied can be easily done, and further, as the sheet separating/supplying means is employed in common, the cost for the apparatus is low because of non-upsizing of the apparatus.

What is claimed is:

1. A sheet supplying apparatus which supplies a sheet in a supplying direction, said apparatus comprising:

a first stacking portion on which first sheets are stacked;

a second stacking portion including a tray on which the second sheets are stacked and a base member for supporting the tray movable between a supplying position and a release position, wherein the second stacking portion receives component force of the gravity at least in the supplying direction; and a supplying roller that supplies the first sheet stacked on said first stacking portion, or the second sheet stacked on said second stacking portion in the supplying direction, wherein when the tray is positioned at the release position, said supplying roller is able to supply the first sheet stacked on said first stacking portion, while when the tray is positioned at the supplying position, the supplying roller can contact with the second sheet stacked on the tray to supply the second sheet stacked on the tray, and wherein said second stacking portion includes a blocking means, the blocking means abuts on the end portion of the second sheet on the downstream side in the supplying direction to prevent the second sheets from coming off the second stacking portion when the tray is positioned at the release position, and the blocking means separates from the end portion of the second sheet on the downstream side and a downstream end of the stacking portion in the supplying direction when the tray moves to the supplying position, and opens a sheet supplying route from said second stacking portion, and wherein the blocking means is supported by the tray and the blocking means is movable integrally with the tray.

2. A sheet supplying apparatus according to claim 1, wherein when the tray moves to the supplying position, said second stacking portion is locked so that said second stacking portion can not be released from said first stacking portion, and when the tray moves to the release position, said second stacking portion is detachable/attachable from and to the first stacking portion.

3. A sheet supplying apparatus according to claim 1, wherein when the tray moves to the supplying position, an abutting portion of said blocking means, which abuts on the end portion of a sheet on the second sheet on the downstream side in the supplying direction, separates from an abutting portion of said first stacking portion, which abuts on the end portion of the first sheet on the downstream side in the supplying direction, and when said supplying roller supplies the second sheet on said second stacking portion, an operation of said blocking means is regulated by a regulating portion provided on said first stacking portion, thereby opening the sheet supplying route from said second stacking portion.

4. A sheet supplying apparatus according to claim 1, wherein the abutting portion of said blocking means, which abuts on the end portion of the second sheet on the downstream side in the supplying direction, includes a guide member for guiding respectively upper and lower sides, in the sheet stacking direction, of a sheet stacked on said second stacking portion when the tray moves to the release position, towards the inside of the abutting portion of said blocking means.

5. A sheet supplying apparatus according to claim 4, wherein said guide member is configured in a shape protruding on the upstream side at least in the sheet supplying direction at the upper and lower portions, in the sheet stacking direction, of the abutting portion of said blocking means.

6. A sheet supplying apparatus according to claim 4, wherein said second stacking portion includes a regulating member for regulating the lower side of the sheet in the sheet stacking direction, and said regulating member is provided in the vicinity of said blocking means and is overlapped with said guide member of said blocking means in the sheet supplying direction.

7. A sheet supplying apparatus according to claim 1, wherein said base member of said second stacking portion includes a cover member for covering the surface of a sheet stacked on said second stacking portion when the tray moves to the release position, and said cover member serves as regulating means for regulating the upper side of a sheet in the sheet stacking direction within an abutting range on the abutting portion of said blocking means.

8. A sheet supplying apparatus according to claim 7, wherein said cover member separates from said second stacking portion when the tray moves to the supplying position.

9. A sheet supplying apparatus according to claim 1, wherein said base member of said second stacking portion is provided with an index at a portion in which the end portion of the sheet is positioned when stacking a sheet on said first stacking portion.

10. A sheet supplying apparatus according to claim 1, wherein said second stacking portion is provided with a cover member that opens and closes when taking the sheet in and out and a sub cover member interlocking with the opening/closing of said cover member, on the upstream side of said second stacking portion in the sheet supplying direction.

11. A sheet supplying apparatus according to claim 1, wherein when the tray is positioned at the supplying position, the pressure plate pushes up the tray together with the first sheet stacked on the pressure plate.

* * * * *